US009899013B1

(12) United States Patent
Stillman et al.

(10) Patent No.: US 9,899,013 B1
(45) Date of Patent: Feb. 20, 2018

(54) FORWARD AND REVERSE DELAY EFFECTS PEDAL

(71) Applicants: EarthQuaker Devices, LLC, Akron, OH (US); Pittsburgh Digital, LLC, Pittsburgh, PA (US)

(72) Inventors: Jamie Ryan Stillman, Akron, OH (US); Michael Thomas Mecca, Pittsburgh, PA (US)

(73) Assignees: EarthQuaker Devices, LLC, Akron, OH (US); Pittsburgh Digital, LLC, Pittsburgh, PA (US)

( * ) Notice: Subject to any disclaimer, the term of this patent is extended or adjusted under 35 U.S.C. 154(b) by 0 days.

(21) Appl. No.: 15/471,121

(22) Filed: Mar. 28, 2017

(51) Int. Cl.
*G10H 1/02* (2006.01)

(52) U.S. Cl.
CPC ..... *G10H 1/02* (2013.01); *G10H 2210/281* (2013.01); *G10H 2230/031* (2013.01)

(58) Field of Classification Search
CPC .. G10K 11/1788; G10K 11/16; G10K 11/175; G10K 15/00; G10K 11/1782; G10K 11/1784; G10K 2210/3045; G10H 1/02; G10H 7/02; G10H 1/055; G10H 1/0058; G10H 1/0091
See application file for complete search history.

(56) References Cited

U.S. PATENT DOCUMENTS 5,569,038 A * 10/1996 Tubman ..... G09B 5/04 434/156
6,453,308 B1 * 9/2002 Zhao ..... G05B 13/048 702/24
2002/0178133 A1 * 11/2002 Zhao ..... G06K 9/62 706/20
2006/0060071 A1 * 3/2006 Kato ..... H04H 60/04 84/645
2006/0103458 A1 * 5/2006 Hansen ..... H03F 3/211 330/10
2013/0118340 A1 * 5/2013 D'Amours ..... G10H 1/0083 84/746
2013/0263721 A1 10/2013 Shavit
2014/0123838 A1 * 5/2014 D'Amours ..... G10H 1/32 84/626
2014/0150630 A1 * 6/2014 Juszkiewicz ..... G10H 1/44 84/626
2014/0238221 A1 * 8/2014 Roberts ..... G10H 1/0553 84/724

* cited by examiner

*Primary Examiner* — Marlon Fletcher
(74) *Attorney, Agent, or Firm* — Louis F. Wagner; FisherBroyles, LLP

(57) ABSTRACT

The invention pertains generally to an effects pedal employing multiple sub-buffers implementing a switching mechanism between forward and reverse delay effects, particularly useful in the music industry.

27 Claims, 20 Drawing Sheets

A Input at Time t
B Input at Time t+1
C in put at Time t+2

D Output at Time t
E Output at Time t+1
F Output at Time t+2

Sample input at time 0 is output at time 1999.

Movement in time of a reverse delay buffer of length 1000, showing transition to a new cycle at time 1000.

1000
Buffer 1
Position
0
(a)

1000
Buffer 2
Position
0
(b)

1000
Buffer 1
Output
Amplitude
0
(c)

1000
Buffer 2
Output
Amplitude
0
(d)

Crossfade
Transition
Time

FORWARD AND REVERSE DELAY EFFECTS PEDAL

TECHNICAL FIELD

The invention described herein pertains generally to the use of an effects pedal employing multiple sub-buffers implementing a switching mechanism between forward and reverse delay audio effects, particularly useful in the music industry, particularly with guitars.

BACKGROUND OF THE INVENTION

Many musical instruments generate an electronic signal as an output to an amplifier or recording device. Examples of such electronic musical instruments include electric guitars, microphones, and synthesizers. The output of such instruments can be readily modified using a device called an effect, which comprises: a means to input the audio signal; specialized audio circuitry to modify or enhance the signal; and a means to output the signal. Examples of effects include reverberation effects to make an instrument sound like it is being played in a large space like a concert hall or cathedral; equalization effects to change the tone of the instrument; and gain effects to boost the amplitude of electric guitar signal in specific ways prior to further amplification.

The input to an effect is an audio signal, which is most typically analog signal (although digital signals can be used) whose voltage varies over time. The output of an effect is also an audio signal, which is most typically an analog signal (although digital signals may be used with special speakers) whose voltage varies over time. In this manner, multiple effects can be used in series for a more complex signal modification.

The internal processing of an effect can typically be adjusted by the user, to some extent, with one or more controls provided in the form of switches, potentiometers, and input devices. Examples of such controls include: a switch to bypass the effect or engage it in the signal path; potentiometers to control intensity or rate; and a jack to accept a variable-voltage device to control some musical expression of sound.

SUMMARY OF THE INVENTION

The present invention is directed to a switching mechanism between a forward delay and a reverse delay as applied to a musical score.

In one aspect of the invention, the device will have: an audio input into one main buffer (preferably, although not necessarily, the main buffer is a circular buffer), the input written to the main buffer at a sample rate; a modified audio output; at least three sub-buffers within the one main buffer, which include: at least one forward sub-buffer within the main buffer which digitally stores audio data for a forward delay effect, the at least one forward sub-buffer having a forward sub-buffer starting location and a forward sub-buffer ending location, a difference between the forward sub-buffer starting location and the forward sub-buffer ending location defining a forward sub-buffer duration; at least one primary reverse sub-buffer which digitally stores audio data for a reverse delay effect, the at least one primary reverse sub-buffer having a primary reverse sub-buffer starting location and a primary reverse sub-buffer ending location, a time difference between the primary reverse sub-buffer starting location and the primary reverse sub-buffer ending location defining a primary reverse sub-buffer duration, the primary reverse sub-buffer duration being shorter than the forward sub-buffer duration, and the primary reverse sub-buffer duration being coextensive with at least a portion of the forward sub-buffer duration; at least one secondary reverse sub-buffer which digitally stores audio data for the reverse delay effect, the at least one secondary reverse sub-buffer having a secondary reverse sub-buffer starting location and a secondary reverse sub-buffer ending location defining a secondary reverse sub-buffer duration, the secondary reverse sub-buffer duration being of a shorter duration than the forward sub-buffer duration, and the secondary reverse sub-buffer duration being coextensive with at least a portion of the forward sub-buffer duration and at least a portion of the primary reverse sub-buffer duration.

In one implementation of the invention, the duration of each of the at least one primary and secondary reverse sub-buffers are approximately equal and wherein the duration of the at least one forward sub-buffer is approximately equal to the duration of the sum of the duration of the at least one primary and secondary reverse sub-buffers.

In another implementation of the invention, the duration of the arithmetic sum of the duration of the at least one primary and secondary reverse sub-buffers is not equal to the duration of the at least one forward sub-buffer and the duration of the overlap of the at least one primary reverse sub-buffer and the at least one secondary reverse sub-buffer is approximately 50%.

In a different implementation of the invention, the duration of the overlap of the at least one primary reverse sub-buffer and the at least one secondary reverse sub-buffer is not equal to approximately 50%.

In an aspect of the invention, the switch between an output of the primary reverse sub-buffer and the secondary reverse sub-buffer occurs approximately at 50% of a duration of either the primary or secondary reverse delay sub-buffer. The primary reverse sub-buffer has a reverse delay sub-buffer #1 mix, and the secondary reverse sub-buffer has a reverse delay sub-buffer #2 mix, and further wherein the reverse delay sub-buffer mix #1=(1.0−reverse sub-buffer mix #2). The switch between an output of the primary reverse sub-buffer and the secondary reverse sub-buffer occurs approximately at a reverse delay half buffer. A change from the forward delay effect to the reverse delay effect occurs essentially instantaneously and wherein a change from the reverse delay to the forward delay occurs at the end of a reverse half-buffer.

Throughout a majority of the duration of either reverse sub-buffer, either reverse buffer mix #1 is approximately 1.0 or reverse buffer mix #2 is approximately 1.0, and the switch in output from the respective reverse sub-buffers occurring as the sub-buffer approaches the half buffer of either reverse sub-buffer #1 or reverse sub-buffer #2. In a preferred implementation, the modified audio output transitions from a reverse delay to a forward delay or from a forward delay to a reverse delay by the activation of a footswitch.

In yet another aspect of the invention, a device is described which includes: an audio input is written into one main buffer (preferably but not required to be a circular main buffer), the input written to the main buffer at a sample rate; a modified audio output; a switch (preferably a foot switch) to change between a forward delay and a reverse delay; three sub-buffers within the one main buffer, which comprise: one forward sub-buffer which digitally stores audio data for a forward delay effect, the forward sub-buffer having a forward sub-buffer starting location and a forward sub-buffer ending location, a difference between the forward sub-buffer starting location and the forward sub-buffer ending location defining a forward sub-buffer duration; one primary reverse circular sub-buffer which digitally stores audio data for a reverse delay effect, the primary reverse sub-buffer having a primary reverse sub-buffer starting location and a primary reverse sub-buffer ending location, a time difference between the primary reverse sub-buffer starting location and the primary reverse sub-buffer ending location defining a primary reverse sub-buffer duration, the primary reverse sub-buffer duration being shorter than the forward sub-buffer duration, and the primary reverse sub-buffer duration being coextensive with at least a portion of the forward sub-buffer duration; one secondary reverse sub-buffer which digitally stores audio data for the reverse delay effect, the one secondary reverse circular sub-buffer having a secondary reverse sub-buffer starting location and a secondary reverse sub-buffer ending location defining a secondary reverse sub-buffer duration, the secondary reverse sub-buffer duration being shorter than the forward sub-buffer duration, and the secondary reverse sub-buffer duration being coextensive with at least a portion of the forward sub-buffer duration and at least a portion of the primary reverse sub-buffer duration; and further wherein the duration of each of the primary and secondary reverse sub-buffers are approximately equal and wherein, the duration of the forward sub-buffer is approximately equal to the duration of the sum of the duration of the primary and secondary reverse sub-buffers.

As mentioned above, the switch between an output of the primary reverse sub-buffer and the secondary reverse sub-buffer occurs approximately at 50% of a duration of either the primary or secondary reverse delay sub-buffers.

The primary reverse sub-buffer has a reverse delay sub-buffer #1 mix, and the secondary reverse sub-buffer has a reverse delay sub-buffer #2 mix, and further wherein the reverse delay sub-buffer mix #1=(1.0–reverse sub-buffer mix #2).

The switch between an output of the primary reverse sub-buffer and the secondary reverse sub-buffer occurs approximately at a reverse delay half buffer and throughout a majority of the duration of either reverse sub-buffer, either reverse buffer mix #1 is approximately 1.0 or reverse buffer mix #2 is approximately 1.0, and the switch in output from the respective reverse sub-buffers occurring as the sub-buffer approaches the half buffer of either reverse sub-buffer #1 or reverse sub-buffer #2.

The change from the forward delay effect to the reverse delay effect occurs essentially instantaneously whereas the change from the reverse delay to the forward delay occurs at the end of a reverse half-buffer. The crossfade between reverse sub-buffer #1 to reverse sub-buffer #2 is between approximately 2 to 25 milliseconds inclusive of the endpoints. Preferably, the default effect for the switch is reverse delay and the switch to change between a forward delay and a reverse delay is a foot-activated switch.

In still yet another aspect of this invention, a device is described which transitions from a forward delay effect to a reverse delay effect or vice-versa which includes: a main buffer which captures audio input; at least three sub-buffers which store a portion of the audio input, at least one sub-buffer which captures audio input for subsequent output as a forward delay effect and at least two sub-buffers which capture audio input for subsequent output as a reverse delay effect; a switch for changing the output from the reverse delay to the forward delay or vice-versa; and wherein the changing of the output from the forward delay effect to the reverse delay effect occurs essentially instantaneously, and the change from the reverse delay to the forward delay effect occurs at the end of a reverse half-buffer of the at least two sub-buffers. Preferably, the switch for changing the output from the forward delay effect to the reverse delay effect is a foot-activated switch and a cross fade between the at least two sub-buffers which capture audio input for subsequent output as a reverse delay effect is between approximately 2 to 25 milliseconds inclusive of the endpoints.

DETAILED DESCRIPTION OF THE INVENTION

The best mode for carrying out the invention will now be described for the purposes of illustrating the best mode known to the applicant at the time of the filing of this invention. The examples and figures are illustrative only and not meant to limit the invention, as measured by the scope and spirit of the claims.

Unless the context clearly indicates otherwise: the word "and" indicates the conjunctive; the word "or" indicates the disjunctive; when the article is phrased in the disjunctive, followed by the words "or both" or "combinations thereof" both the conjunctive and disjunctive are intended.

As used in this application, the term "approximately" is within 10% of the stated value, except where noted.

Figure 1:
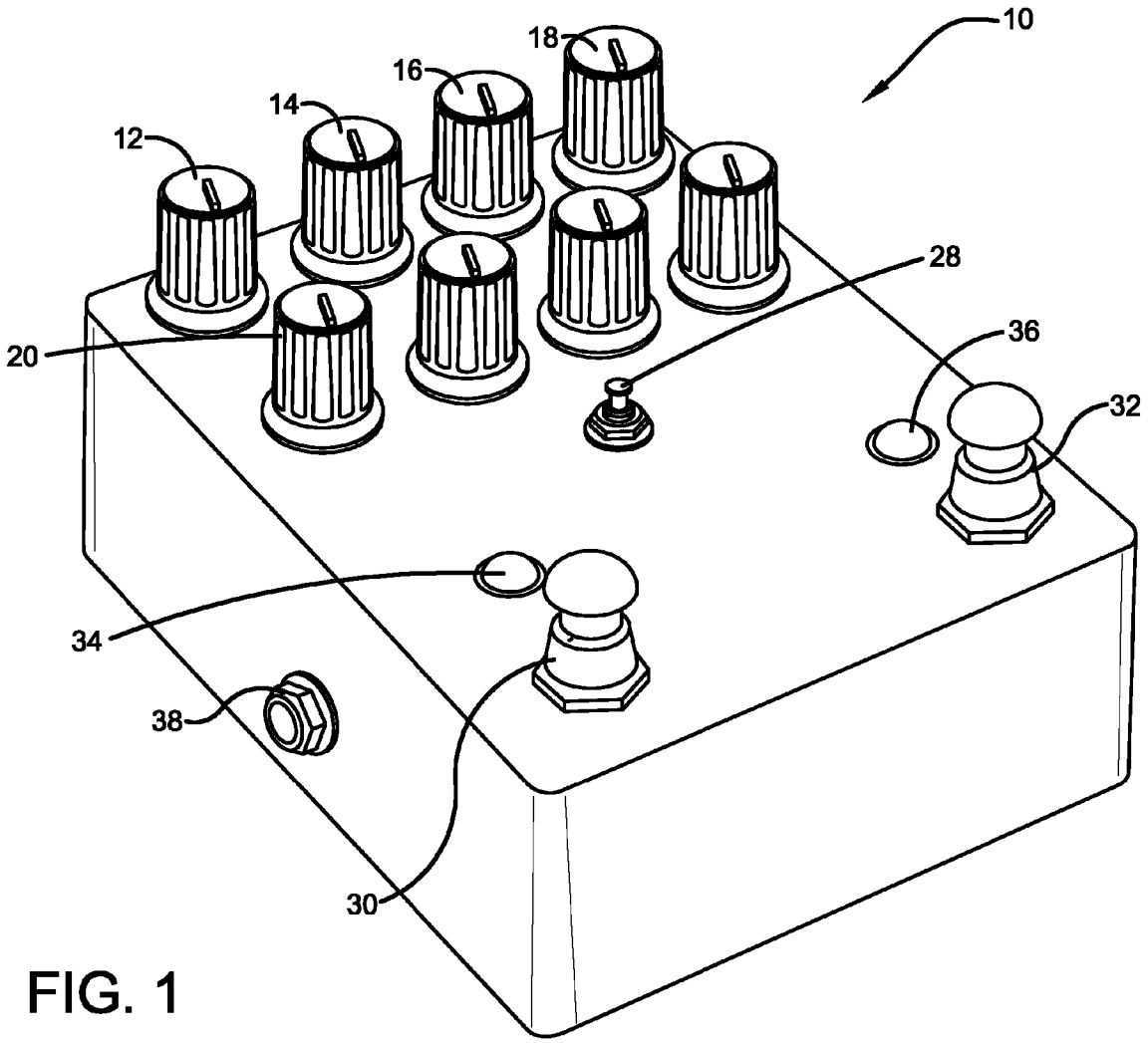
FIG. 1 is a perspective view of an effects pedal.

The preferred embodiment contains switch, preferably a foot switch although other selector devices which change between effects is within the scope of this invention; input section; output section; processor with memory and a plurality of controls for parameters delay time, delay feedback, and mix. In the preferred embodiment, the pedal executes a reverse delay by default. When the footswitch is depressed, there is an instant and seamless transition to forward delay. When the foot switch is released, there is likewise an instant and seamless transition back to reverse delay. Many effects are embodied within rugged enclosures that are intended to sit on the floor and be controlled by the musician's feet. Such effects are generally called effect pedals. In addition to foot controls, other controls are often provided as adjustments to by set by hand. An example of an effect pedal is shown in FIG. 1. In this figure, effect pedal 10 is shown having the ability to perform a number of effects and a plurality of controls, including but not limited to time delay $T_d$ 12 which controls the delay time and goes from approximately 0 milliseconds ("ms") to approximately 2000 ms, number of repeats 14 which controls the regeneration of the delay, from zero repeats to near an infinite number, tone 16 which controls the tone for the delay line only—roll off highs to the left, roll off lows to the right and get a flat response in the middle, mix 18 which is the volume control for the delay line—blends in the wet with dry until 1 o'clock, 1 o'clock to 3 o'clock boosts the wet signal over the dry and 3 o'clock up brings down dry until it is fully wet when all the way up, EXP (equivalently Expression Jack Assign Switch) 20 with associated input jack 38, which maps the expression jack to one of the assigned controls, namely: Decay—which controls the reverb decay length; R Mix—which controls the reverb mix; Time—which takes over for the delay time control and is different than the interface control—using the expression pedal to control the time will give all kinds of wild effects that cannot be achieved by turning the knob; Repeats—which controls the delay repeats; D Mix—which controls the delay mix; Toggle—which takes over for the toggle switch and will cross fade from forward delay in heel down position to reverse delay in toe down position, decay 22 which controls the decay length of the reverb, short decay counterclockwise, long cavernous decay clockwise, mix 24 which is the volume control for the reverb—blends in the wet with dry until 1 o'clock, 1 o'clock to 3 o'clock boosts the wet signal over the dry and 3 o'clock up brings down dry until it is fully wet when all the way up, ratio selector switch 26 which selects delay subdivisions when time is set by the "Tap" switch: 1/1-quarter note; 3/4-dotted $8^{th}$ note; 2/3-quarter note triplet; 1/2-8th note; 1/3-8th note triplet; 1/4-16th note, toggle switch (mode selector) 28 both, which is the "standard" delay and reverb mode, reverse, which is the reverse delay mode with "standard" reverb, and swell, which is the volume swell mode, activate 30 with associated lighted indicia 34, and tap 32 with associated lighted indicia 36. Associated output jacks are not illustrated in the figure, but positioned at the top of the pedal.

A highly useful effect for musicians is the forward delay effect which creates one or more echoes, or repetitions, of what the musician is playing, and combines those repetitions with the musician's input signal. The input to a forward delay effect is an audio signal. The output of the forward delay is the forward delay's input signal, delayed by some amount of time. It is worth noting here, though not essential to this discussion, that the input and output of a forward delay can be combined with each other both after and before the forward delay to create some wonderfully compelling musical results. This "mixed" output of pedal 10 can be used as "input" to create even more advanced effects.

Figure 2:
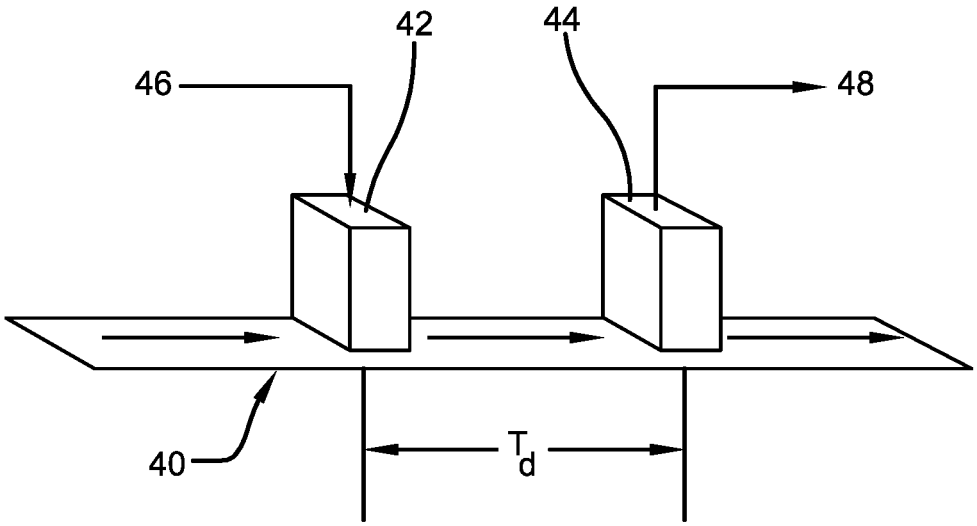
FIG. 2 is a depiction of a delay effect using a pair of magnetic tape heads.

Historically, a specific forward delay effect called tape echo was once commonly used on voice and guitar. Tape echo is created with a magnetic tape machine, where a forward delay is created due to the physical distance between the record head, which stores the audio information on the tape, and the playback head, which reads the audio information from the tape. FIG. 2 illustrates the mechanism responsible for tape echo using a magnetic record and playback head. Magnetic tape 40 moves from left to right under the record 42 and playback 44 heads. Audio from input signal 46 is stored on the tape 40 at record head 42. Magnetic tape with stored audio moves from left to right at some rate, and over some period of time $T_d$, to playback head 44. Playback head 42 outputs the delayed audio 48 with delay $T_d$ later than the input audio 46. It should be noted that it is possible to increase or decrease the delay time by moving the playback head further from or closer to the record head.

Figure 3:
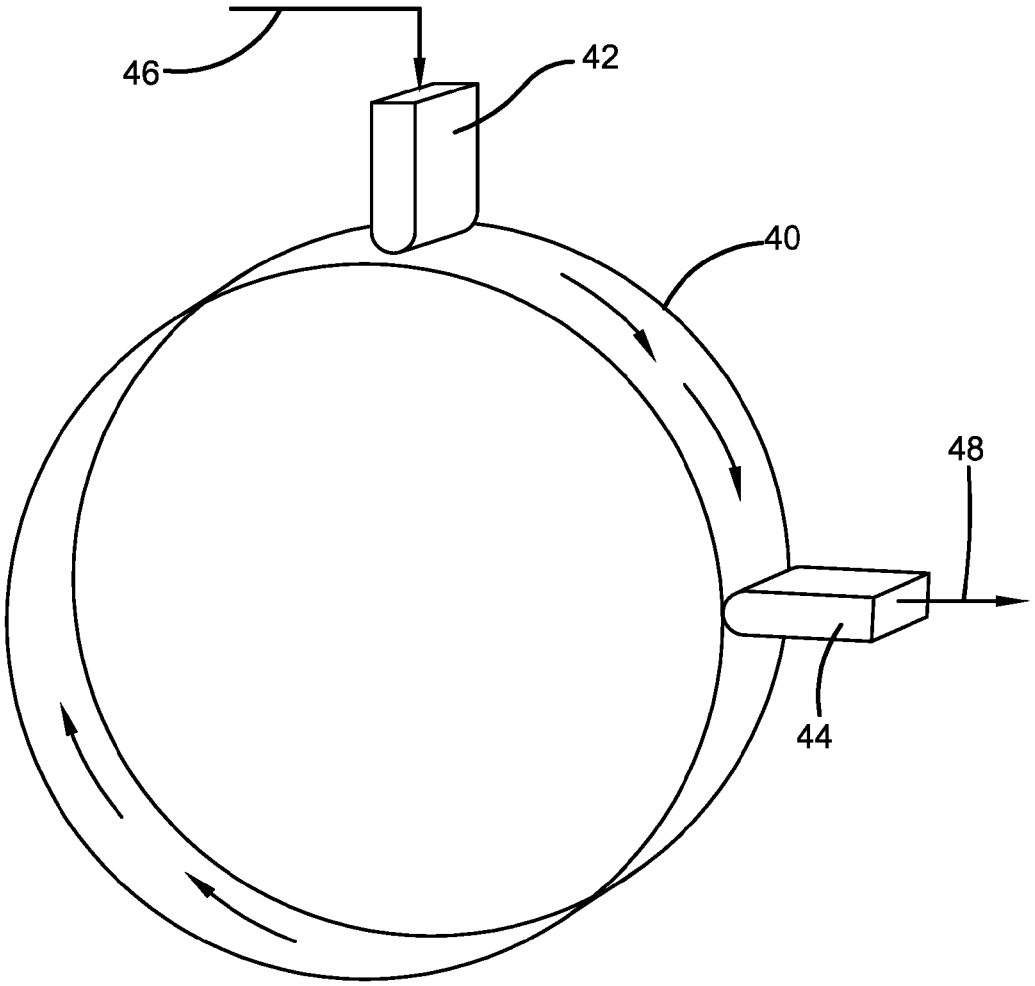
FIG. 3 is a depiction of a delay effect using a continuous loop, using a similar concept to that described with respect to FIG. 2.

As better illustrated in FIG. 3, it is possible to envision tape 40 formed into a long, continuous loop of arbitrary length moving clockwise in the figure, such that it may be continually run through the machine, whereby the tape is circulated in a clockwise manner such that the record head precedes the playback head.

It should be noted that once audio has been stored on the tape, the tape can be pulled backward, from right to left across the playback head, or counter-clockwise, to play the audio in reverse. As used in this application, the term "forward delay" to refer to conventional delay effects as described above, and "reverse delay" to refer to delay effects that play back the audio in reverse.

Figure 4:
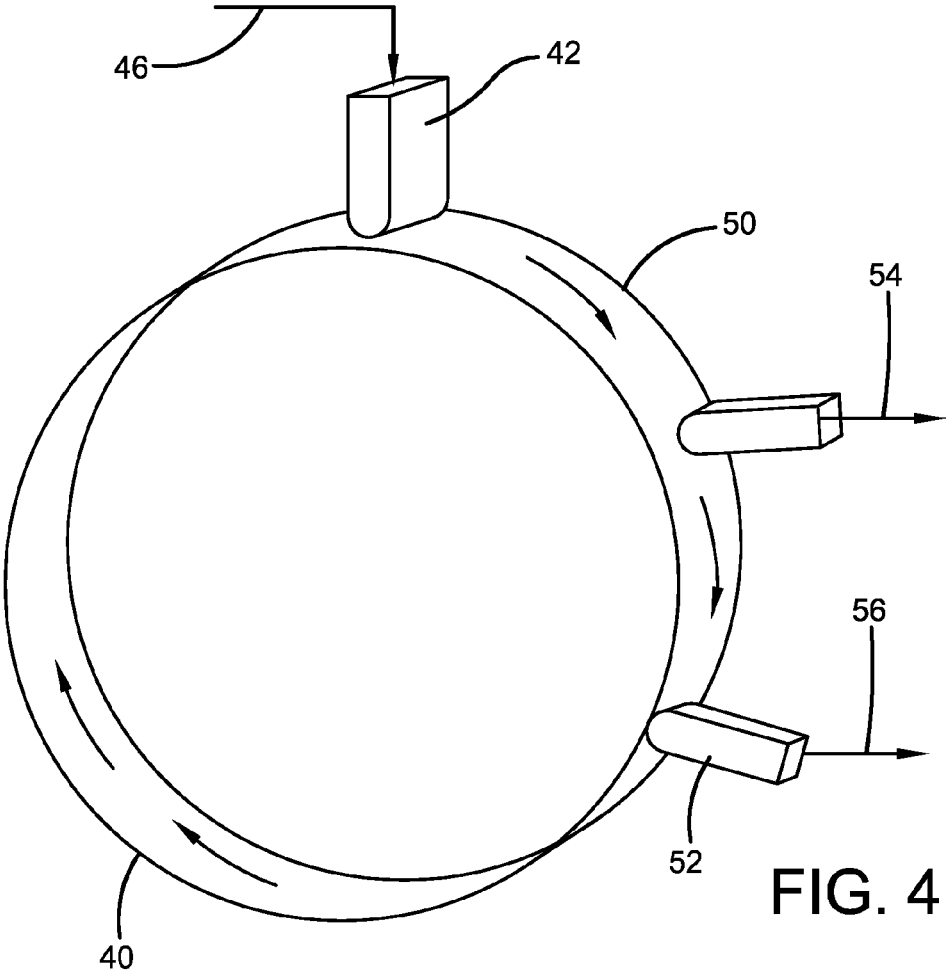
FIG. 4 is a depiction of a delay effect using a continuous loop having two playback heads, each having an associated output signal.

It is also possible to consider a tape loop 40 having two playback heads 50, 52 that can move independently, and pass each other in location as illustrated in FIG. 4, showing a tape loop with two playback heads, each with an associated output signal 54,56. This is the analog version of a digital mechanism that is required by the invention, detailed below.

Figure 5:
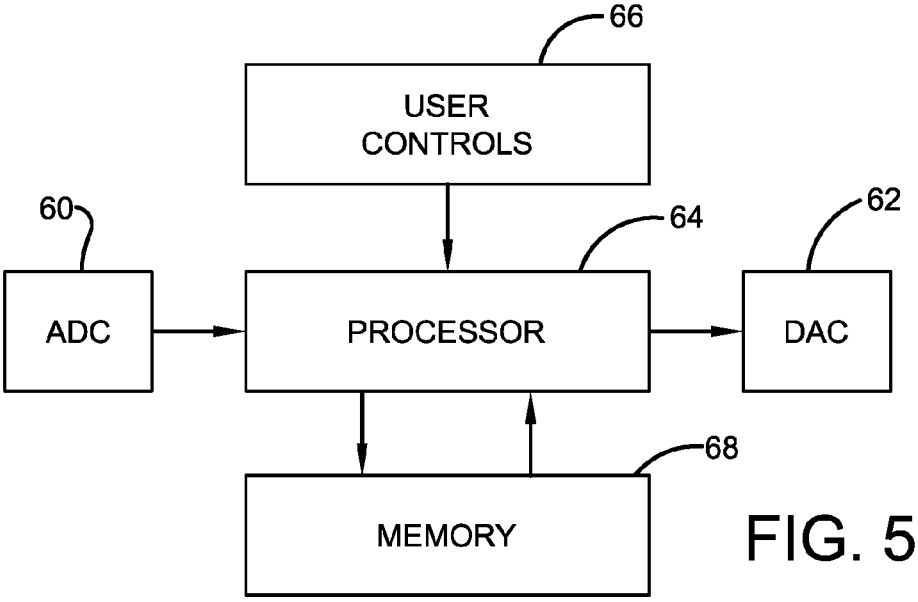
FIG. 5 is a schematic block diagram of a digital system.

A digital audio effect system comprises an input section 60; a processor 64 having user interface 66, sufficient memory 68; and an output section 62 as better illustrated in FIG. 5. Examples of digital audio effects systems include digital effects pedals for electric guitars, rack-mounted effects used in recording studios, and PC-based recording hardware.

The input section typically combines analog and digital circuitry, centered about an analog-to-digital converter (ADC) 60. The ADC produces binary samples at a specific sample rate, where the stream of samples is a digital representation of the analog audio input to the system. The output section typically combines analog and digital circuitry, centered about a digital-to-analog converter (DAC) 62. The DAC produces an analog signal from a stream of binary values that represent a stream of audio.

The processor 64 is a computational device that manipulates digital data from its input in order to produce a desired effect at its output. The processor's behavior may be controlled by a plurality of switches, potentiometers, and other input devices 66. The processor 64 requires memory 68 to retain audio data, sufficient to meet the requirements of its specific effect. For example, a tone effect to adjust bass and treble generally requires very little memory. A long reverberation effect requires much more memory. The amount of applicable or required memory of the processor is well within the skill of a person having ordinary skill in the art.

An analog audio signal is digitized by an analog-to-digital converter (ADC) which samples its voltage at a fixed rate of times per second Fs, where each sample is a digital number corresponding to the audio signal at that specific instant of time. Fs is the sample rate of the system. For example, a common sample rate used to record audio is 48000 samples per second, or Fs=48 kHz. This digital system outputs these samples at the same sample rate Fs to a digital-to-analog converter (DAC) that converts digital samples to an analog audio signal once again. The sample rate mentioned above is for illustrative purposes only and both higher and lower sample rates are within the scope of the invention.

A digital audio effect, or digital effect, modifies a digital representation of an audio signal at its input to create a certain result at its output. For the purposes of this application, the means of modification is an algorithm run on a processor, and controlled with analog mechanisms such as potentiometers and switches.

One very common and highly useful digital effect is the forward delay, in which the processor outputs a modified copy of the input audio after some period of time, $T_d$. A conventionally implemented forward delay effect temporarily stores a copy of the audio input signal, and continuously plays back that stored audio signal delayed by some amount of time after the original audio has been recorded.

With digital technology, storing a digitized copy of audio data for some period of time before it is output by the system creates a delay. Digital data comprise samples, with each corresponding to the amplitude of the analog audio signal at an instant of time. The rate at which audio is sampled is Fs samples per second, so the number Fs samples represent one second of audio.

Figure 6:
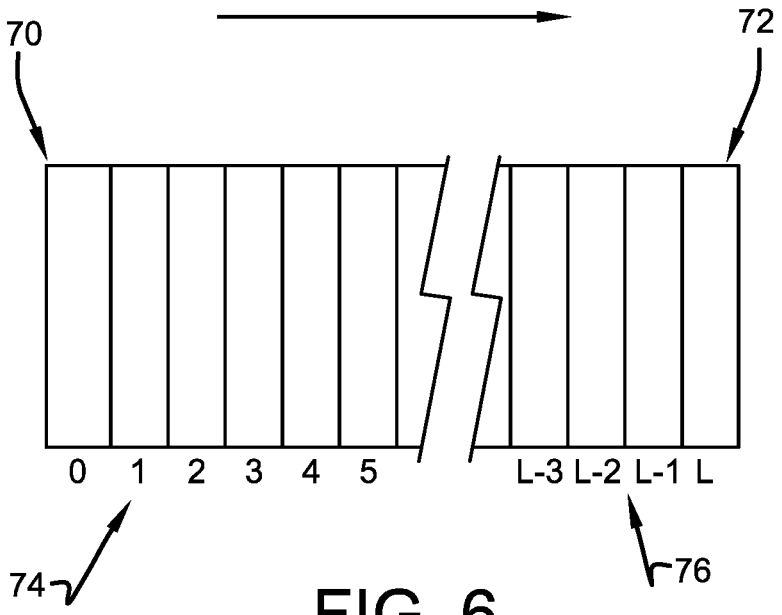
FIG. 6 is a depiction of a pedal of the present invention.

A time delay is introduced into the digital audio by storing the data for some period of time. It is convenient to think of a long series of samples—a buffer—that stores some number of samples corresponding to some time duration of audio. The length of time corresponds to the number of samples (illustrated by reference number 74) between the start 70 of the buffer, where an input sample is written, and the end 72 of the buffer which is L samples long (illustrated by reference number 76), where the output sample is read as illustrated in FIG. 6. As mentioned above, a common sample rate for professional audio is 48 KHz samples per second, or Fs=48000. The time duration corresponding to one sample of audio is 1/Fs, or 20.83333 microseconds. To create a one half second delay on an audio signal at sample rate 48000, the output would be delayed by 24000 samples. In this case 24000 samples need to be stored in the system to create a half second delay.

Figure 7:
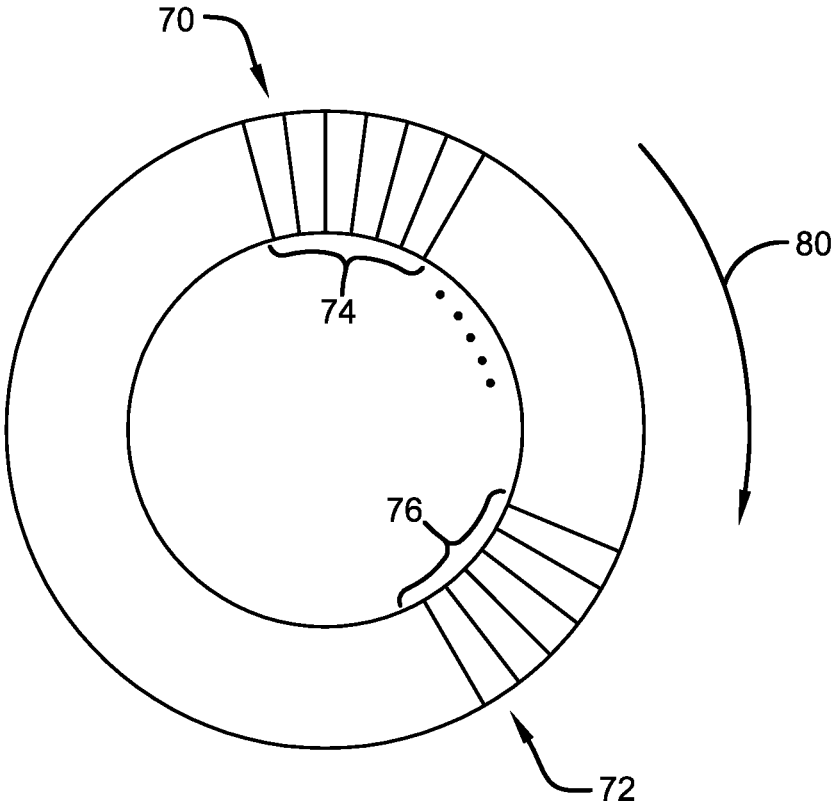
FIG. 7 is a depiction of a digital delay effect using a continuous loop.
Figure 8:
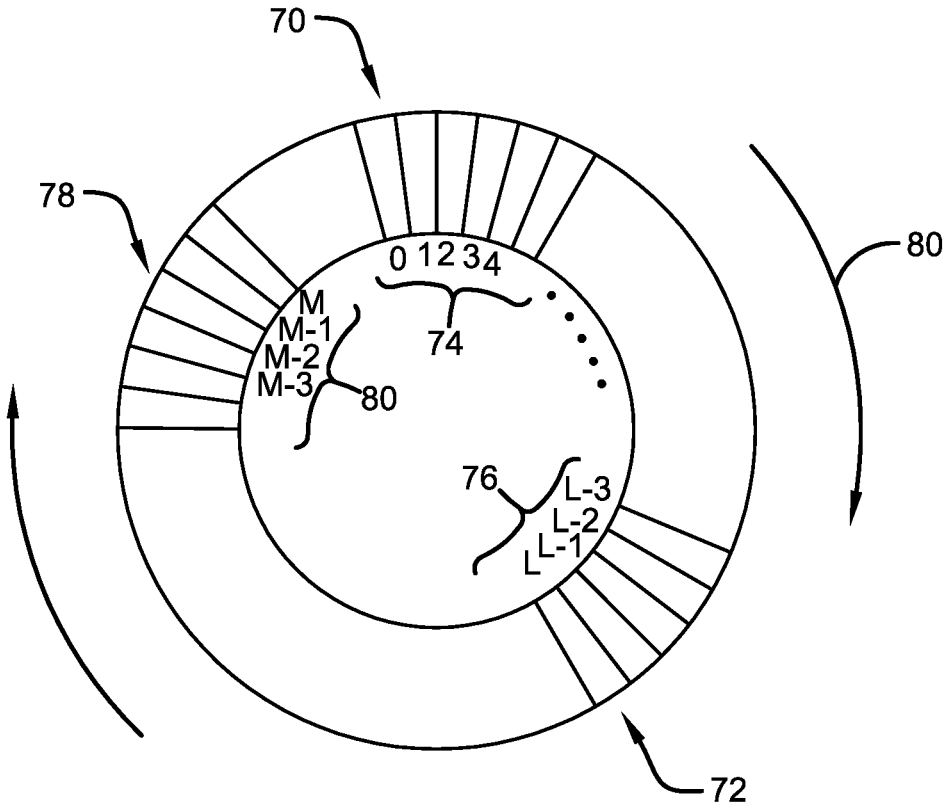
FIG. 8 is a depiction of a digital delay effect using a continuous loop and two output signals.

Furthermore, as better illustrated in FIG. 7, a buffer may be arranged into a circular form. The digital circular buffer is analogous to the tape loop shown earlier. Whereas a tape loop may have two playback heads that it uses to generate two outputs, data from a circular buffer may be read from two different locations 72,78 to permit two independent outputs 76,80 having two different delay lengths as illustrated in FIG. 8. While a circular buffer is generally preferred for the main buffer for ease and simplicity of mathematical calculations, there is no need to limit the invention to such, it is merely the preferred embodiment.

Analogous to the tape delay previously described, input audio can be collected into one or more buffers and played back in reverse. Further, it has been illustrated how multiple sub-buffers can be implemented in overlapping fashion within a singular circular buffer. Note that even though these sub-buffers have independently different points from which the outputs are read, and may even be different lengths, they all share the same audio data by virtue of having only one common location at which they are written to. It is important to note that while all of the audio data are stored within one common circular buffer, for the purposes of this application, sections of that larger circular buffer act as independent smaller sub-buffers to illustrate the underlying mechanism of the invention.

Among musicians who use effects, forward delay is widely considered to be one of the very most essential effects. While it is generally regarded as less essential, reverse delay is also a popular and exciting effect. Reversing audio for musical creation was more traditionally accomplished by reversing the direction of magnetic tape recording in a playback machine, or spinning a vinyl recording in reverse direction on a turntable. With the advent of digital technology in the 1980s, utilizing this effect in real time as part of a musical performance became technologically feasible and commercially practical.

While the output of a forward delay is predictable and isochronous with respect to its input, a reverse delay is not so predictable. To a great extent, it's the unpredictability of a reverse delay that makes it so compelling to interact with in performance.

Figure 9:
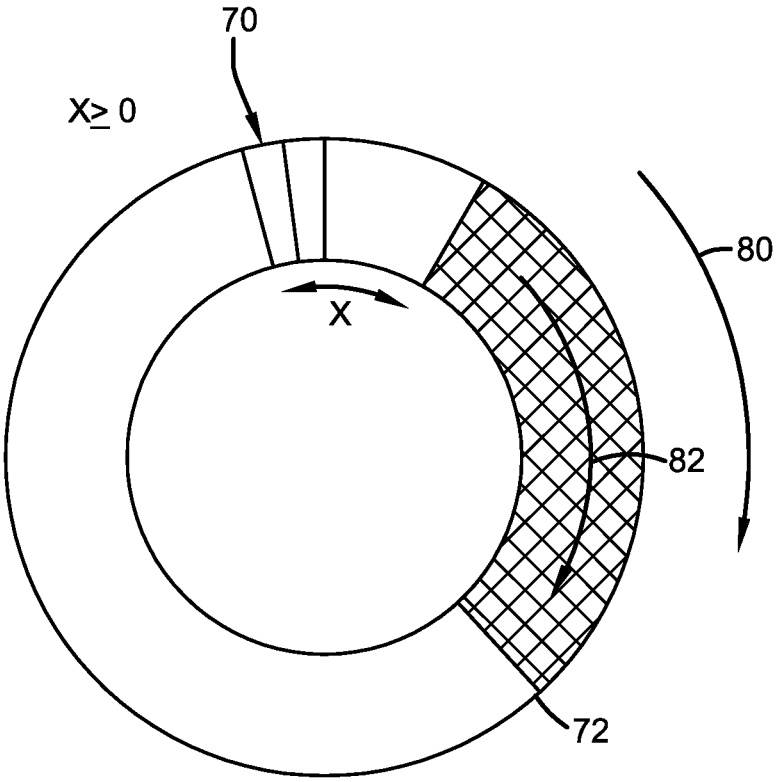
FIG. 9 is a depiction of a digital reverse delay using a circular buffer.

By necessity, reverse delay is implemented with at least one buffer that stores audio for a period of time, to be played back in reverse. For the reverse delay effect, playback 82 begins at an endpoint 72, playing audio backward in time to a starting point 70, such that the starting point occurs at a later time than data are entered into the buffer. That is to say, data cannot be read from the buffer before it is written to the buffer, as illustrated in FIG. 9 by the gap "x".

The choices for buffer length, location of buffer start points, and location of buffer end points all influence the reverse delay's performance. Typically, buffer lengths are long enough to store a series of musical notes that can be played back in reverse order. Endpoint locations may always be located at a fixed time length from the beginning of the buffer. Alternatively, the endpoints may be located using a more musically sensitive method, such as positioning the endpoint between notes, or at a break in a musical phrase. The invention described herein works equally well using any such method.

Figure 10:
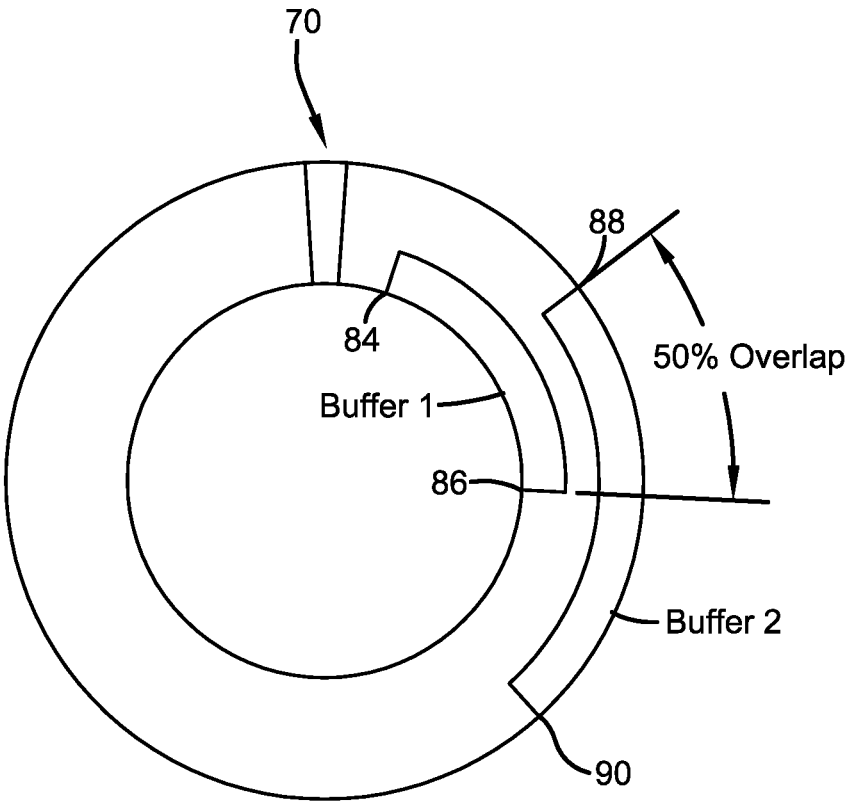
FIG. 10 is a depiction of overlapping sub-buffers.

To ensure that all or most of the input audio data is (at some point) also output by the reverse delay, the preferred embodiment comprises two or more sub-buffers that overlap in time, preferably by 50% although both smaller and larger overlaps are within the scope of the invention, as illustrated in FIG. 10. For the instance when two sub-buffers are used (see reverse sub-buffer #1 having a duration between 84 & 86 and reverse sub-buffer #2 having a duration between 88 and 90), they are filled up simultaneously, and playback is such that they are combined to provide an output that is perceived as a single voice.

Typically, forward and reverse delays are implemented on identical hardware. As such, products that feature a reverse delay almost always provide a forward delay as well, Of the products containing both, there is generally a means provided for a user to switch from forward to reverse delay, and back.

Figure 11:
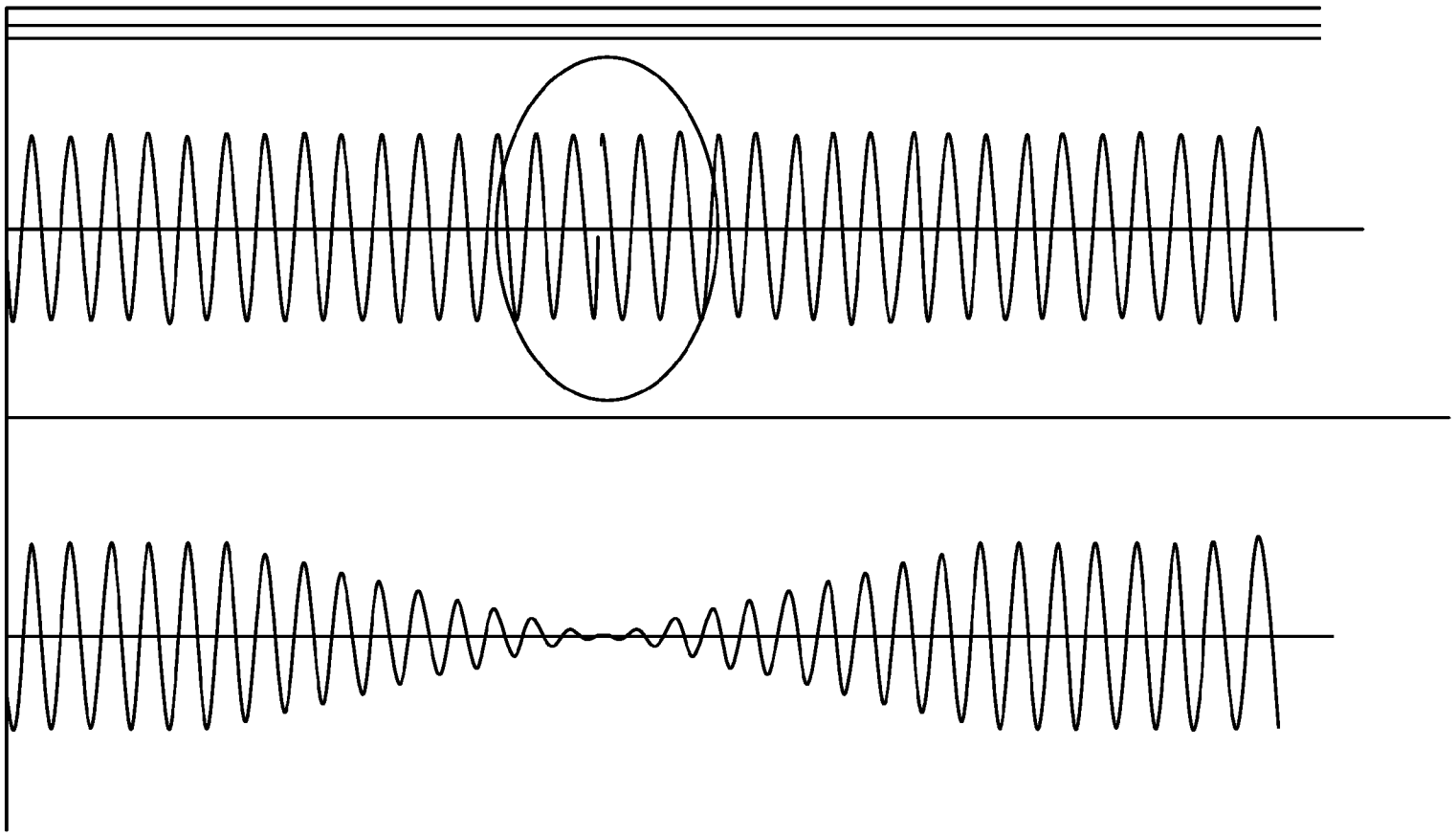
FIG. 11 is a depiction of a discontinuity.

The ease with which one may transition between forward and reverse delay in a live performance is critical for how useful the effect is. There are two methods employed by prior art to permit switching between forward and reverse delay involving discontinuities (see FIG. 11 wherein the upper portion of the figure shows a discontinuity in the audio (circled) and wherein the lower portion shows how that same signal is faded out and faded in to make the discontinuity inaudible): (1) a change that fades all of the effected audio out and in; and (2) a cross-fading between forward and reverse. Both of these prior art solutions have issues that are resolved by the present invention.

Effect products that provide both forward and reverse delay generally provide the means to switch between forward and reverse delay types. Sometimes a hand switch of some kind is provided, such as a rotary switch, which has distinct disadvantages for musicians. Those who wish to keep both hands on an instrument like a guitar or keyboard have no extra hand available to switch. Other times a greatly superior foot switch is provided to change between forward and reverse. Regardless of switching method, if a forward delay effect is switched to a reverse delay effect, the resulting discontinuities in the audio are offensively audible unless measures are taken to eliminate them.

To overcome the problem of discontinuities, effects processors reduce the amplitude of the audio to zero prior to making the switch, and then increase the amplitude back to normal after the switch has been made. Such a reduction of audio is called a fade out, and the complementary increase is called a fade in. In verb form fading in and fading out are commonly used terms. A trade-off is made in the fade time between a fast fade that is less disruptive but more likely to show discontinuities and a slow fade that presents no discontinuities but is highly disruptive to a performing musician.

It is also common practice in such products to "clear buffers" between programs, which entails the insertion of zero-amplitude data throughout all delay buffers. The result of clearing buffers is an even longer disruption in performance and not a preferred solution.

A second method of transitioning between forward and reverse delay is the addition of a mixing potentiometer that fades between forward and reverse delay. This is implemented with a cross-fading switch. In this case a forward delay is always actively outputting data, and a reverse delay is always actively outputting data. A means to control the portion of forward and reverse in the output is provided. When turned all the way down, only one of the two delays is output. When turned all the way up, only the other of the delays is output. In the middle, there is some proportion of both outputs. In this manner, two amplitudes are continuously controlled, which eliminates clicks and pops due to discontinuities, and also eliminates the disruptions of fading the audio out and in.

As we have noted above, the reverse delay is asynchronous in nature and inherently unpredictable. While an advantage of the cross-fading method permits a user to access both types of delay at any time, a clear disadvantage is that periods of transition between one side and the other result in two simultaneously output audio streams that conflict rhythmically, if not also harmoniously.

One prior art solution which permitted hands-free operation, employed a cross fading system with an expression pedal. An expression pedal is a means to continuously control a function by pivoting ones foot on a pedal. Dozens of stand-alone expression pedals are commercially available from reputable manufacturers. Among them are several relatively compatible interfaces for use with a much wider range of effect pedal products.

Compared to a simple foot switch, a clear disadvantage of an expression pedal is the additional expense of such a controller. If the expression controller is built into the product, the manufacturing cost of the entire product increases commensurately. If an input jack is provided in a product—also an added expense—for an expression pedal input, the burden is placed on the user to provide this extra accessory in order to use any features requiring an expression pedal. An additional burden for users is to ensure that the expression pedal used is compatible with the effect pedal's expression pedal interface, as there are several standards.

A secondary disadvantage has to do with space requirements. A market trend among pedal users is to mount all pedals onto a single board, where reliable connections can be made, and where a case is built in to allow the entire assembly to be packed like a piece of luggage for portability. An expression pedal takes up a lot of space on such a board. If multiple expression pedals are needed to interface to effects processor pedals, there is very little space left on the board for other useful pedals.

A third disadvantage in using an expression pedal to switch between effects has to do with a user being required to balance while standing above the controller. By contrast, a footswitch on a pedal permits the user to stand with two feet firmly in place.

A fourth disadvantage has to do with musical performance that can be cognitively demanding. Stepping on a foot switch requires almost no additional resources. Stepping in time is a musically natural activity, sometime even involuntarily so. By contrast, pivoting one foot on a controller in performance while balancing on the other requires far more concentration than should be necessary to switch from one setting to another. The best switching mechanism for musical performance is one that requires the least effort and cognitive resources, such as a momentary stomp switch.

To overcome all of the above disadvantages of prior art, the present invention provides a footswitch interface to switch between forward delay and reverse delay, and means to automatically and instantaneously switch from one delay mode to the other, such that the transition is perceived as immediate and seamless.

A footswitch is used to move between forward mode and reverse mode. For a fast mechanical response, a low resistance momentary switch is preferred. When no force is applied to the switch, there is no conduction between the two electrical leads of the switch, and for our purposes, it is in its off position. When downward force is applied, the switch's plunger goes down and internally connects its two electrical leads, turning it on. An internal spring provides upward force against the plunger such that the switch turns off immediately once downward force is removed.

The preferred embodiment has a default mode that is engaged when the switch is not pressed, and changes to its non-default mode when the switch is pressed. In our work, the default mode chosen is reverse mode, and pressing the switch changes to forward mode.

The preferred embodiment implements all delays—forward and reverse—within a singular (preferably circular) buffer, such that data is shared among them. Efficiency in both computation and in data memory is gained by writing the input signal only once to this single buffer, rather than writing multiple times to multiple buffers. In other words, regardless of whether in forward or reverse delay mode, only one sample is input to the larger circular buffer at the sample rate of the system.

The implementation of a circular buffer is important to this design. However, an implementation based on "flat" buffers is more instructive to see how the preferred embodiment functions. For this reason, an explanation is given to show the equivalence of a singular circular buffer to a number of flat buffers that share the same data, and the invention will be described within the paradigm of multiple flat buffers. A flat buffer is within the scope of this invention.

Figure 12:
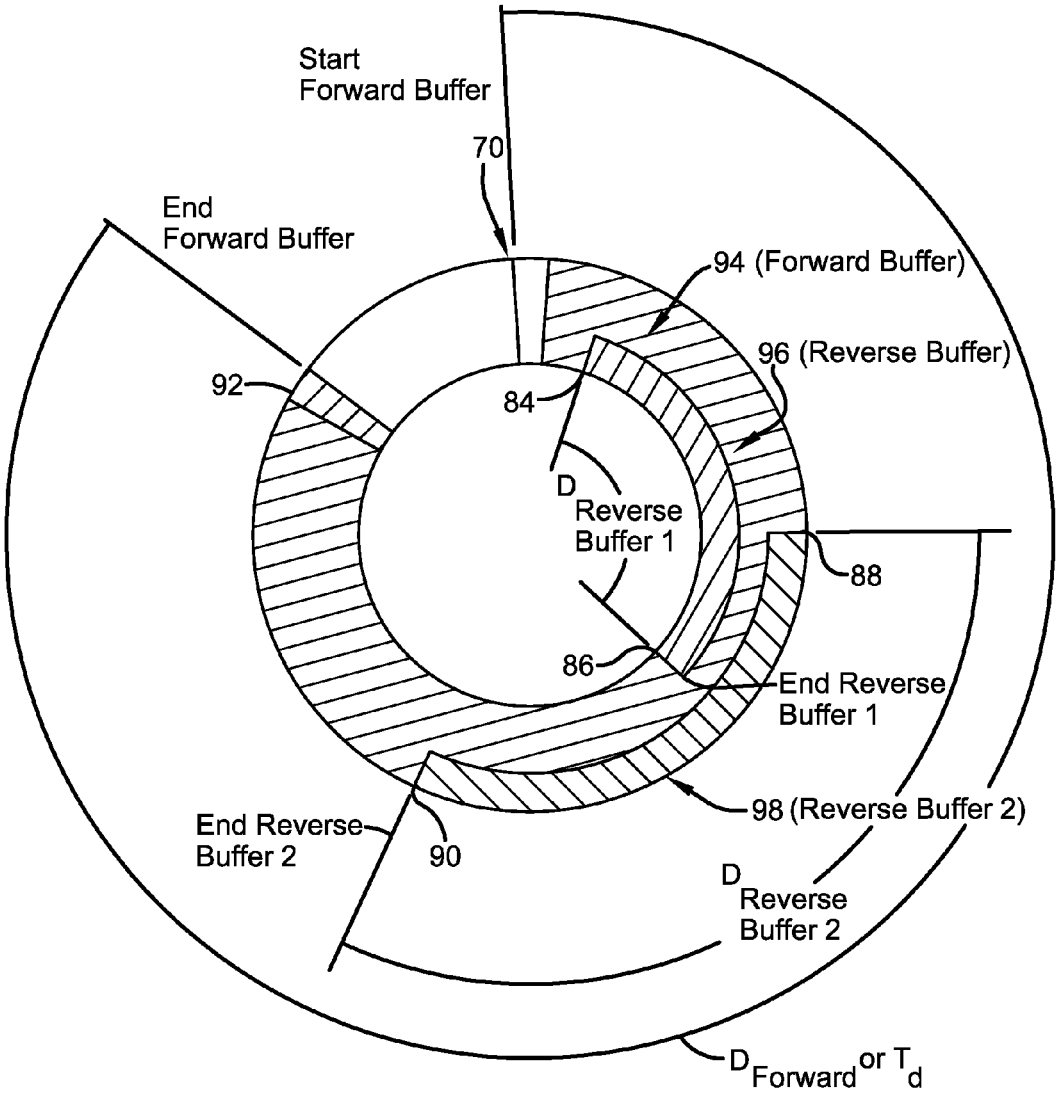
FIG. 12 is a depiction of a circular buffer having three sub-buffers, one sub-buffer for the duration of the forward delay, one sub-buffer for the duration of a portion of the reverse delay and one sub-buffer for the duration of the rest of the reverse delay, the two reverse delay sub-buffers in overlapping physical location and duration.

FIG. 12 shows a preferred embodiment of the buffer structure of the present invention, recognizing that more sub-buffers may be employed, and which as illustrated in the figure employs three sub-buffers that share data: (1) a forward sub-buffer (reference number 94), (2) a reverse sub-buffer #1 (reference number 96), and (3) a reverse sub-buffer #2 (reference number 98). Forward sub-buffer 94 has a physical starting location 70 and an ending location 92, a difference between the forward sub-buffer starting and ending locations defining a time duration (forward) or $T_d$. Reverse sub-buffer #1 and reverse sub-buffer #2 are preferably, but not necessarily, the same length or duration, but preferably are $T_{d/2}$, and in a preferred embodiment, overlap by approximately 50% although it is to be recognized that both smaller and larger overlaps are envisioned within the scope of the invention. The length of the forward sub-buffer is $T_d$, must be no longer than the length of the entire circular buffer. In the illustrated circular buffer, data flows clockwise, although the invention would work equally well if the data flowed counter-clockwise, making the appropriate changes.

Figure 13:
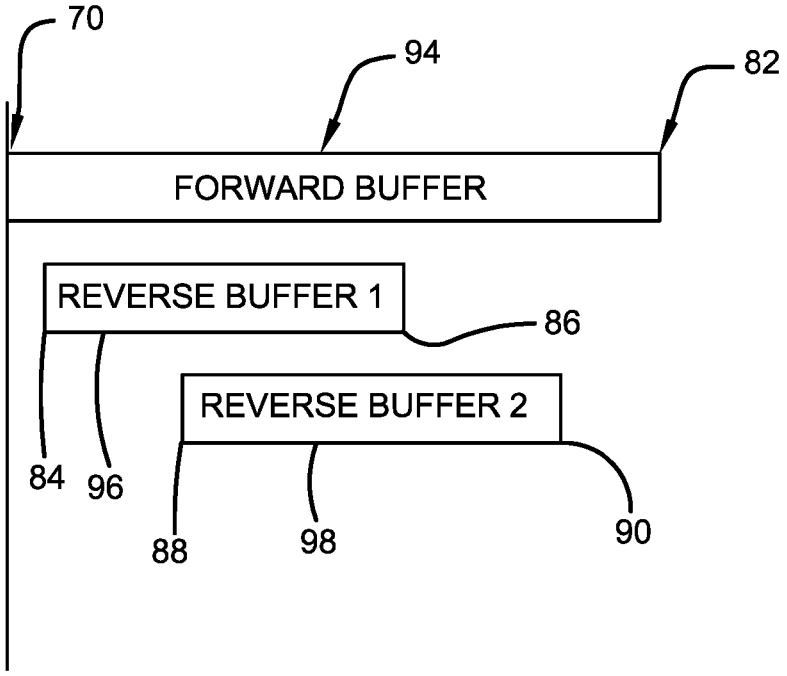
FIG. 13 is a flat representation of FIG. 12.

Illustrated slightly differently, FIG. 13 is a flat representation of the above same three sub-buffers: forward sub-buffer 94, reverse sub-buffer #1 96, and reverse sub-buffer #2 98. It is shown how these equivalently overlap in time, as well as described in the previous paragraph.

Figure 14:
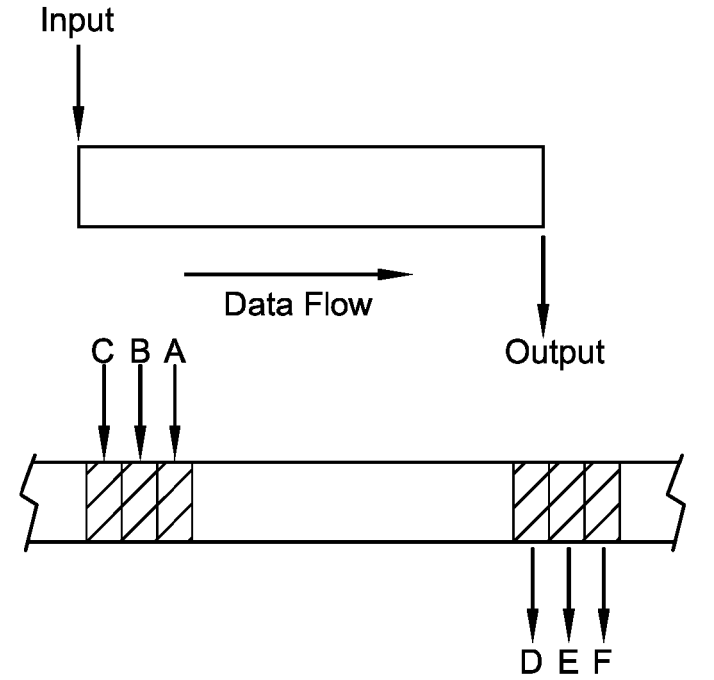
FIG. 14 is a flat representation of a forward delay.
Figure 16:
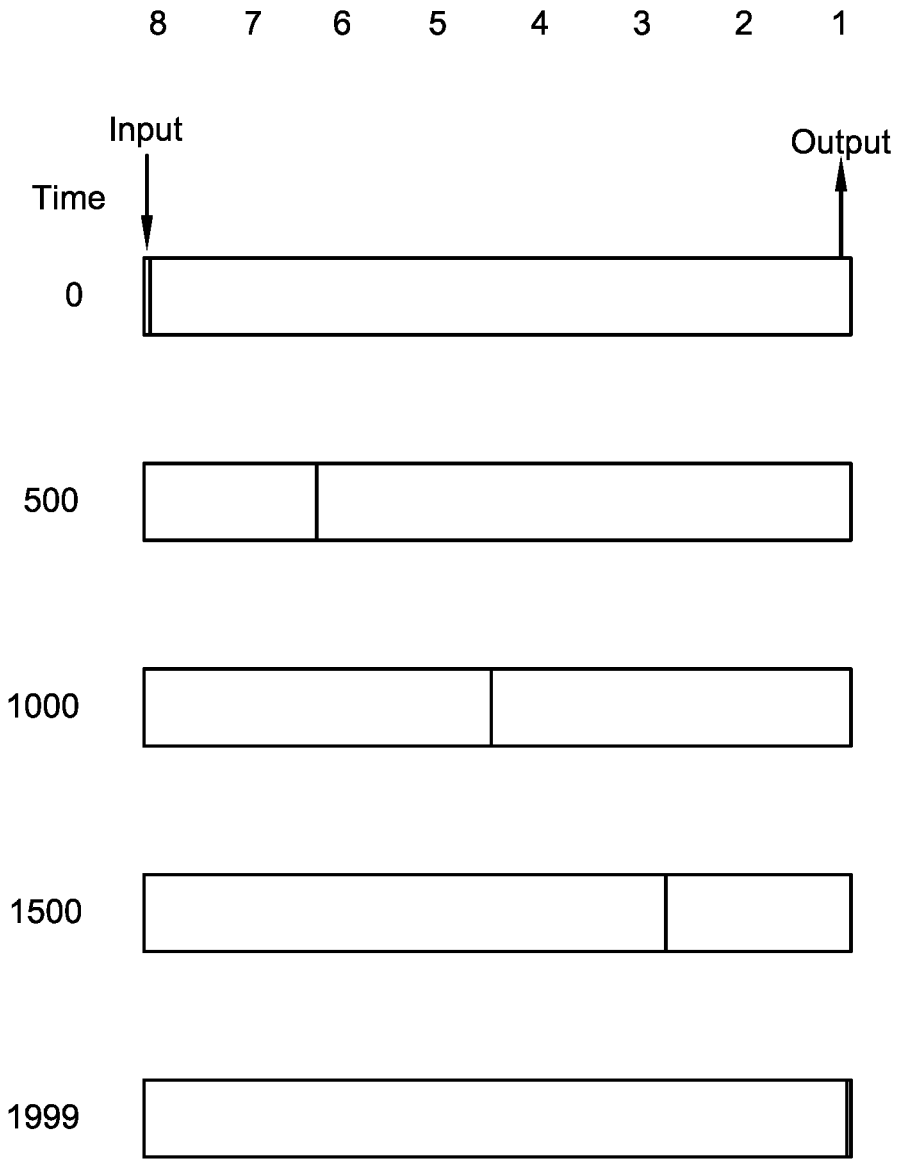
FIG. 16 is complementary with FIG. 14 illustrating a single sample's movement in time in a forward delay sub-buffer (illustrated by the up arrow in this and following figures) of 2000 samples.

The flat representation of a forward sub-buffer, a single sub-buffer of length $T_d$, is detailed in FIG. 14. In forward mode, under typical operation when we are not in the process of switching to reverse mode, one sample is input to the sub-buffer and that same sample is output Td seconds later. The input sample at time t is written into the sub-buffer at location A. The output sample at time t is read from location D. At time t+1, the input is written to location B and output is read from location E. Hashed lines show the extent of the forward sub-buffer at times t and t+1. To understand the mechanism of the forward delay, it is crucial to see that the same sample that is written to location A at time t is read at location D at time t+Td; the successive sample written to location B at time t+1 is read at location E at time t+Td+1; and the successive sample written to location C at time t+2 is read at location F at time t+Td+2; etc. In a complementary manner with FIG. 14, FIG. 16 illustrates a single sample's movement in time in a forward delay buffer of 2000 samples. The sample input at time 0 is output at time 1999.

Figure 15:
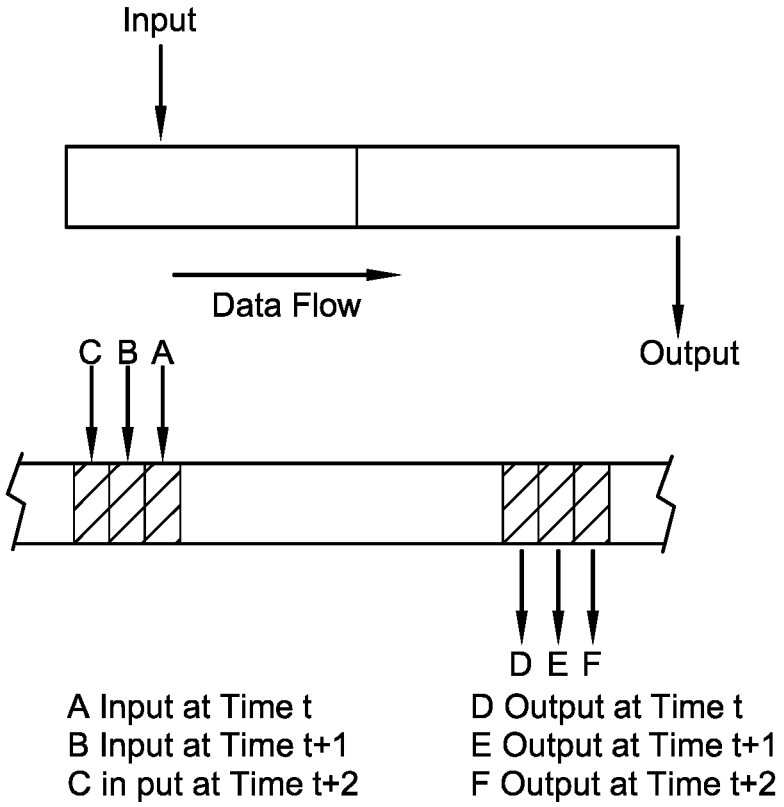
FIG. 15 is a flat representation of a reverse delay.
Figure 17:
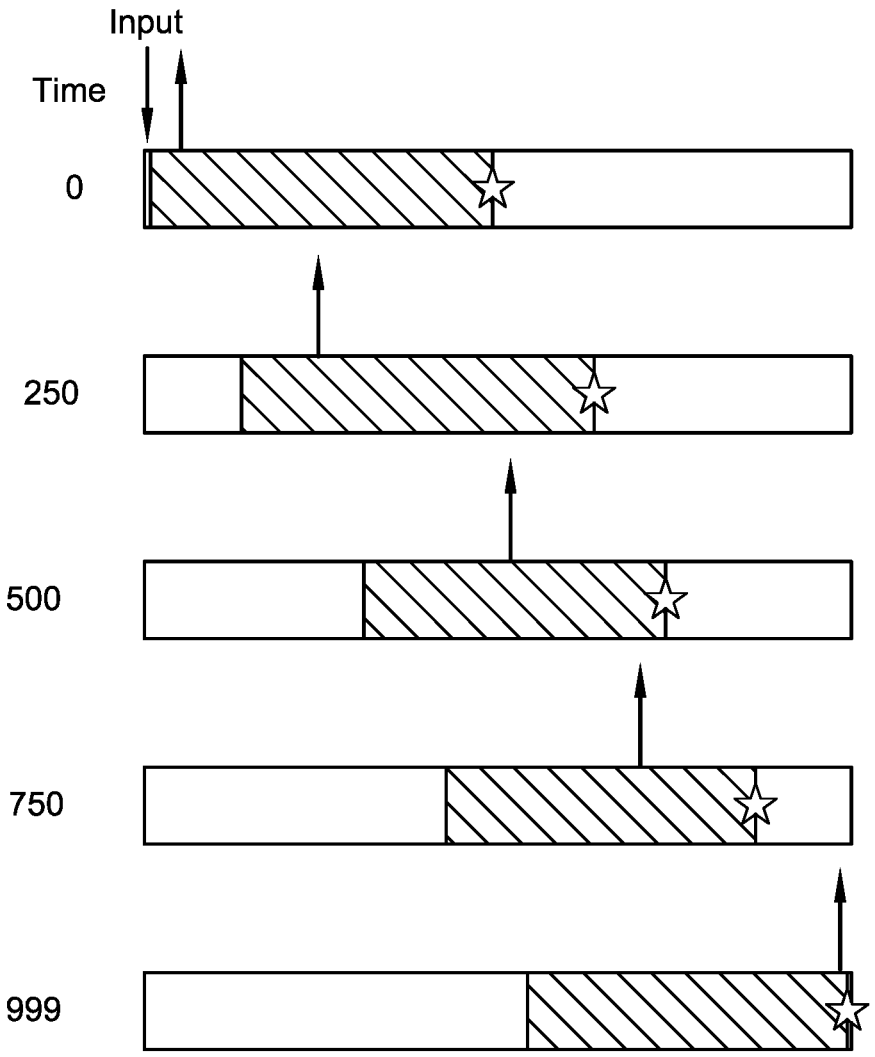
FIG. 17 is complementary with FIG. 15 illustrating a single sample's movement in time in a reverse delay sub-buffer of 1000 samples.
Figure 20:
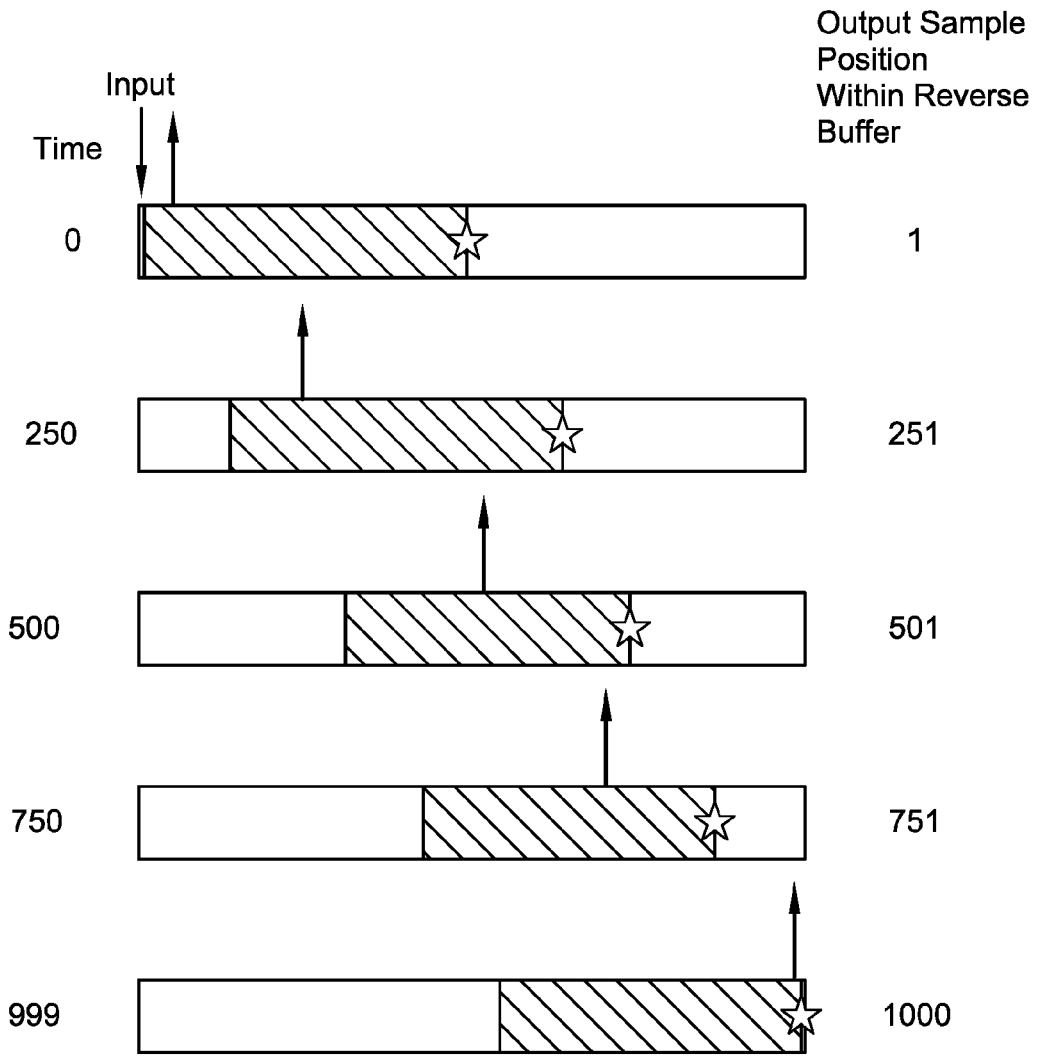
FIG. 20 is similar to FIG. 17 adding the concept of a counter to the output sample position within a reverse sub-buffer.

The flat representation of a reverse sub-buffer is shown in FIG. 15. While the forward delay sub-buffer and reverse delay sub-buffer share the same input mechanism, and the direction of data flow is identical, they differ at the output. To create a reverse delay, the reverse sub-buffer's output location is successively brought away from the input. The input at time t is written to location A, and the output is read from location D. At time t+1, the input is written to location B, and output is read from location E. To understand the mechanism of the reverse delay, it is crucial to see that the same sample that is written to location A at time t is read at location D at time t+Td; the successive sample written to location B at time t+1 is read at location E at time t+Td+1; and the successive sample written to location C at time t+2 is read at location F at time t+Td+2; etc. In a complementary manner with FIG. 15, FIG. 17 illustrates the movement in time of a reverse sub-buffer of length 1000 samples across a forward sub-buffer of length 2000 samples. A small upward arrow shows the reverse sub-buffer output. The sample input at time −1000 is output at time 1000, denoted by a "star", such that the effective delay at the end of its sub-buffer is exactly 2000. FIG. 20 is similar to FIG. 17 adding the concept of a counter to the output sample position within a reverse sub-buffer.

Figure 18:
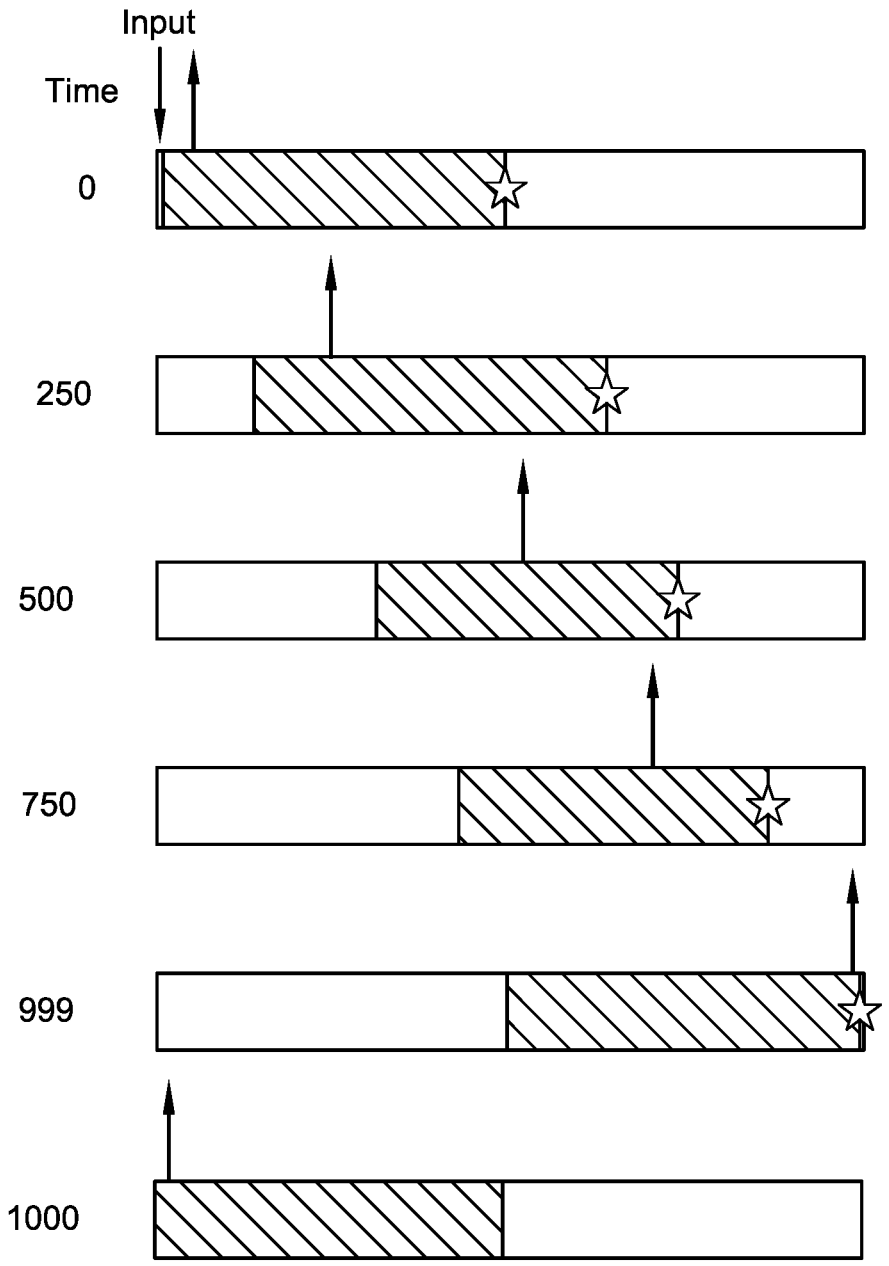
FIG. 18 is similar to FIG. 17 illustrating a reverse delay sub-buffer transitioning to a new cycle at time 1000.

The reverse delay sub-buffer is not infinitely long. Once the output locations approach the end of the sub-buffer, such that the delay between input and output is the length of the sub-buffer, the output location must be brought back closer to the input location. A simple mechanism to control this is a sample counter. It is initialized to 1, and incremented with each successive sample input to the sub-buffer. Once the sample counter becomes equal to the sub-buffer size, it is set back to 1. FIG. 18 illustrates a movement in time of a reverse delay sub-buffer of length 1000, showing the transition to a new cycle at time 1000.

If the output of the reverse delay were generated using one buffer, whose output location changed as described above, there would be unpleasant abrupt discontinuities in the audio signal at the buffer boundaries. One solution to avoid these discontinuities is to reduce the amplitude of the output signal to zero as we approach the end of the buffer (a fade out), where the sample counter is near the buffer length; and increase the amplitude of the output signal back to 1.0 once we start the buffer anew (a fade in), where the sample counter is a low number near 1. The disadvantage of doing so is that some audio content is entirely lost in the process, around the end-of-buffer event. It is possible that a note is dropped or some other significant event in the audio stream is lost.

Figure 19:
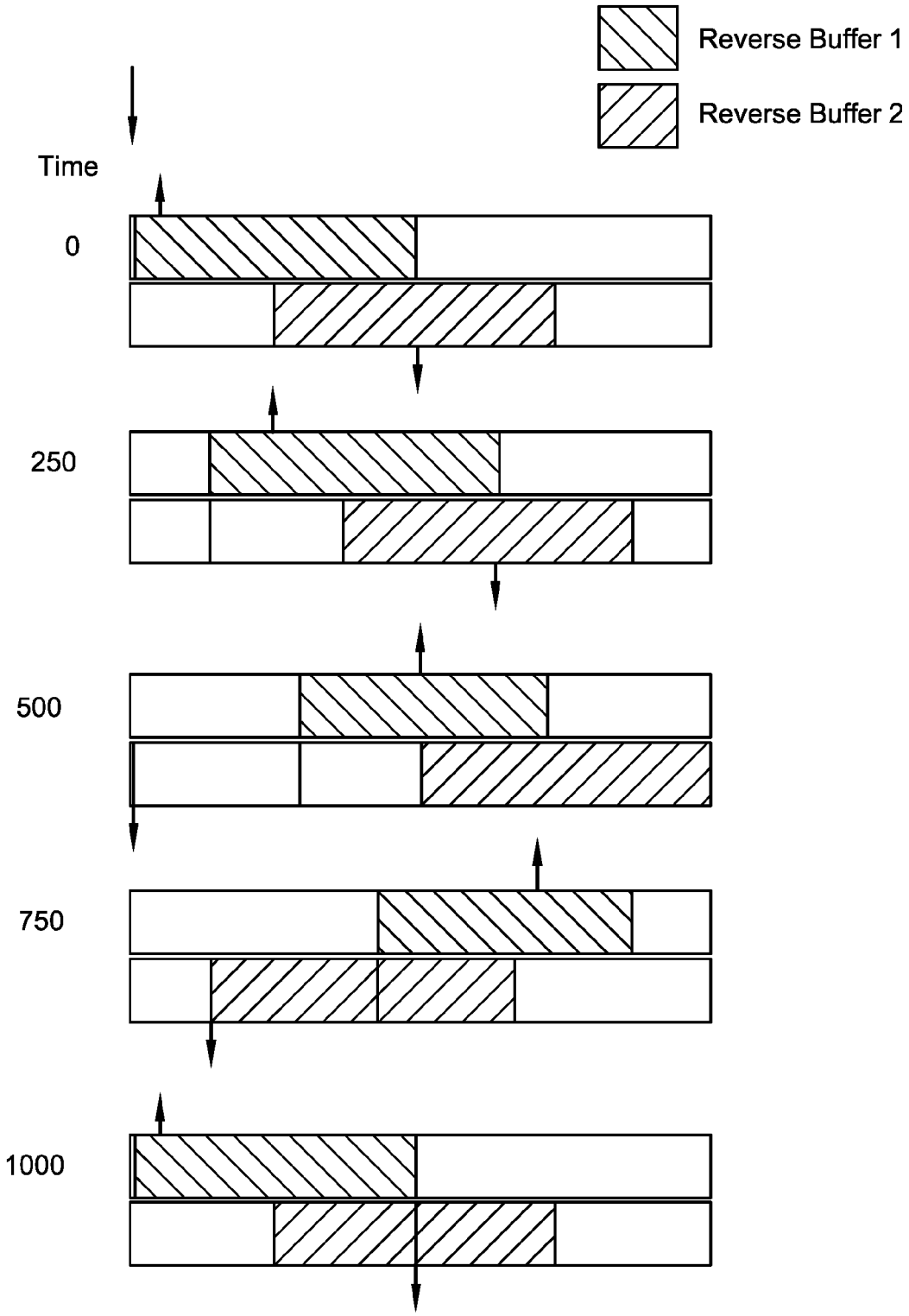
FIG. 19 is a depiction of two reverse delay sub-buffers which overlap by 50% with reverse sub-buffer #2 recycling at time 500 and reverse sub-buffer #1 recycling at time 1000.

To avoid such a loss of audio content, the present invention utilizes at least two reverse sub-buffers, but preferably reverse sub-buffer #1 and reverse sub-buffer #2. For symmetry, these reverse sub-buffers overlap by 50%. Each sub-buffer has its' own independent sample counter, and output location. When one reaches its end, the other is at its 50% point as illustrated in FIG. 19 which illustrates that reverse sub-buffer #1 recycles at time 500 and reverse sub-buffer #2 recycling at time 1000. With such a mechanism in place, it is possible to fade between buffers yet not lose any musical content. We will refer to the output locations of reverse sub-buffer #1 and reverse sub-buffer #2 as reverse sub-buffer output sample location #1 and reverse sub-buffer output sample location #2, respectively.

It should be noted that a similar reverse delay effect could similarly be achieved with more than two reverse sub-buffers. However, it is the expectation that some amount of simplicity and elegance is achieved through the symmetry of a two sub-buffer solution. In addition to independent outputs and sample counters, the two reverse delay sub-buffers have a mix coefficient called respectively, reverse sub-buffer #1 mix and reverse sub-buffer #2 mix.

Figure 21:
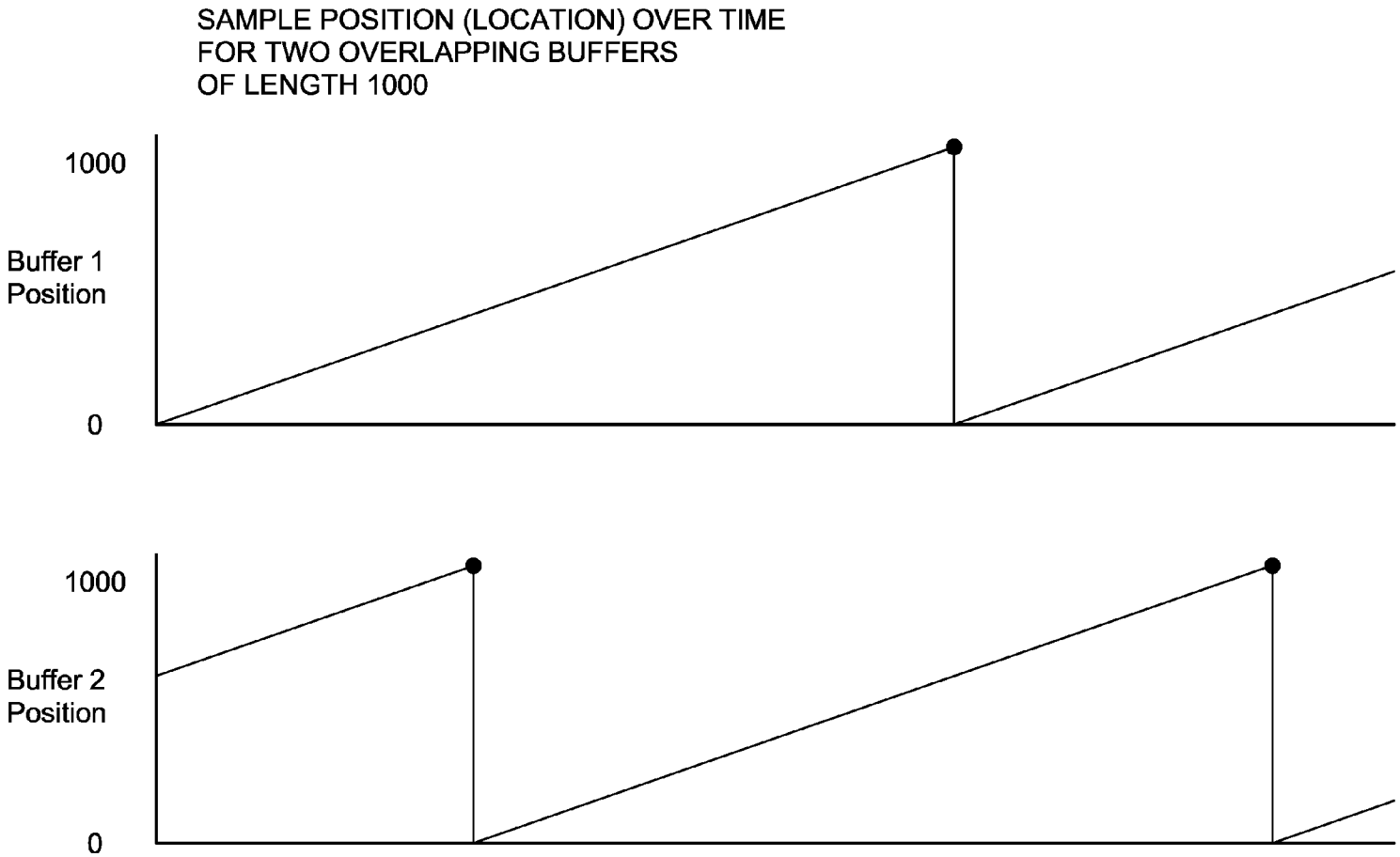
FIG. 21 illustrates how reverse sub-buffer #1 mix and reverse sub-buffer #2 mix are set according to which of the sub-buffers are currently outputting reverse audio.

Reverse sub-buffer #1 mix and reverse sub-buffer #2 mix are set according to which of the sub-buffers, i.e., reverse sub-buffer #1 or reverse sub-buffer #2, is currently outputting reverse audio that is far enough away from the input sample—to be most musically compelling—yet not near a sub-buffer end. In this manner as better illustrated in FIG. 21. It is possible to optimize long continuous segments of audio played back in reverse. As such, reverse sub-buffer mix #1 is maintained at a value close to 1 right up to near the end of its limit, when it is quickly brought to zero coincidentally as reverse sub-buffer mix #2 quickly increases to 1. The two reverse sub-buffers quickly cross-fade from one to the other at a period of Td/2, providing an interesting effect that plays back the input audio in reverse as illustrated in FIG. 22.

Sample counters for reverse sub-buffer #1 and reverse sub-buffer #2 keep track of how many samples have been processed in respective reverse sub-buffer #1 and reverse sub-buffer #2 since the last point of switching from one to the other. Output sample locations determine from where output data are read from their respective reverse sub-buffer #1 and reverse sub-buffer #2.

Figures 22A, 22B, 22C, 22D:
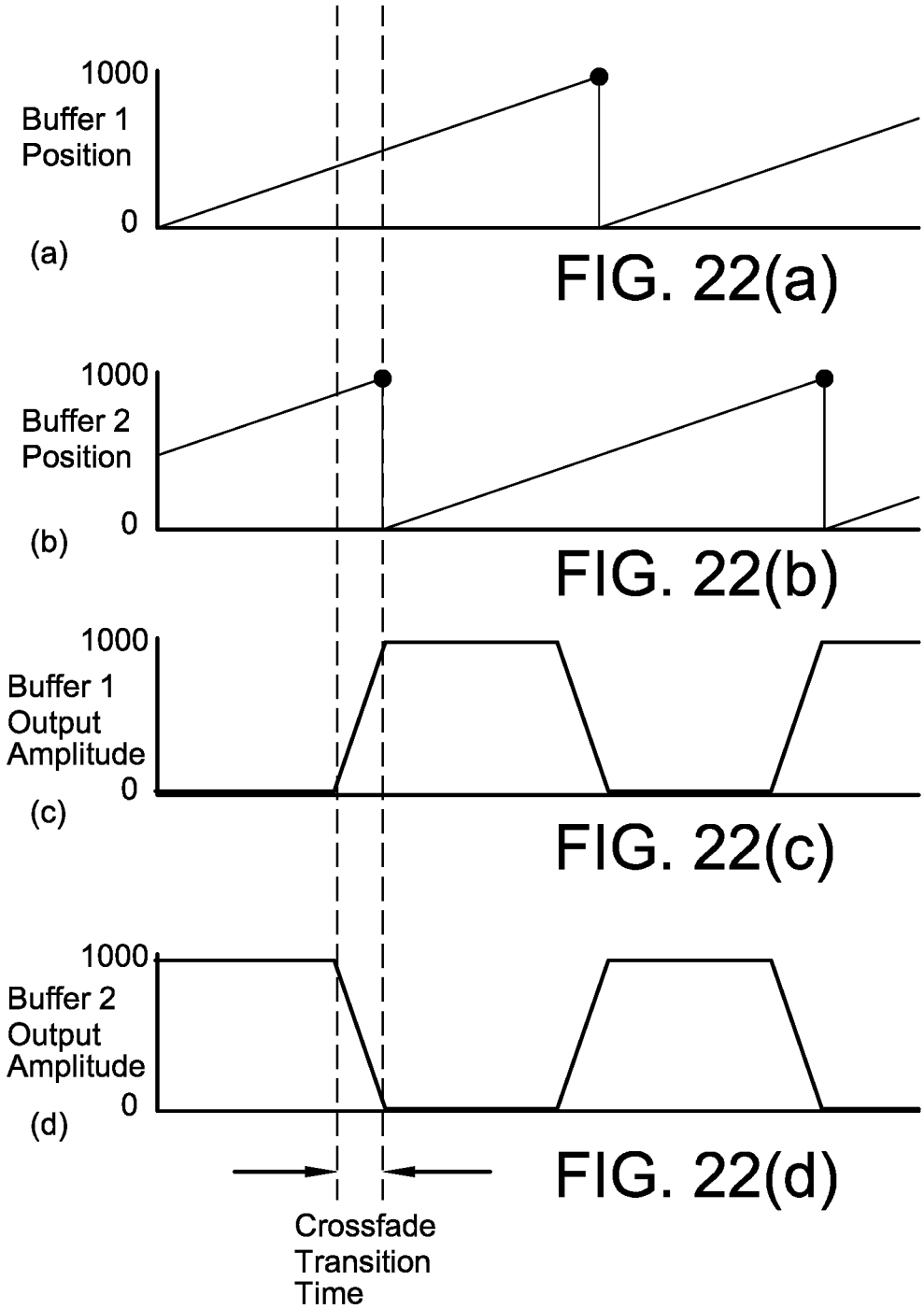
FIG. 22(*a*)-FIG. 22(*d*) are depictions of the output of respective reverse sub-buffer #1 and reverse sub-buffer #2 which are also partially illustrated in FIG. 21.

Throughout most of the cycle, either reverse sub-buffer mix #1 is approximately 1.0, or reverse sub-buffer mix #2 is approximately 1.0, whereas the other is approximately 0.0 as shown in FIGS. 22(*a*) and 22(*b*). As better illustrated in FIGS. 22(*c*) & 22(*d*) reverse sub-buffer mix #1 and reverse sub-buffer mix #2 are complementary, in that it is always the case that reverse sub-buffer mix #1=(1.0−reverse sub-buffer mix #2).

A short duration of time at the conclusion of each reverse sub-buffer's playback is used to cross fade from one reverse sub-buffer to the other reverse sub-buffer, according to a time constant set, the value of which in practice ranges from 2 to 25 ms, more preferably 4 to 15 ms.

A complete switchover from one reverse sub-buffer to the other is made to coincide with sample counter #1 or sample counter #2 reaching its limit, indicating that data are no longer valid in its respective sub-buffer. In this manner, when the effect is continuously in reverse delay mode, reverse sub-buffer #1 and reverse sub-buffer #2 are allowed to effectively alternate, to create the reverse delay's output. Because each reverse sub-buffer is one half the size of the forward delay, in our discussions regarding mode changes below, we will refer to this point of reverse buffer switching as the end of a "half buffer".

An exciting effect is the instantaneous switching from forward to reverse mode, or from reverse to forward mode. A press or release of a switch initiates this switching of delay mode. In the preferred embodiment, it is a momentary footswitch. In accordance with the preferred embodiment, pressing the switch changes mode from reverse to forward, and releasing the switch changes mode from forward to reverse.

There is an asymmetric mechanism for switching delay modes. While switching forward mode to reverse mode is instantaneous, switching from reverse to forward delay, occurs at the end of a half-buffer.

In the switch from forward mode to reverse mode, the forward delay output is immediately and rapidly faded out, and the reverse delay outputs begin. The rate of this fade has been experimentally determined to be between 20 to 100 ms, more preferably 40 to 80 ms.

Because the input to the overall circular buffer is continuous, always, there is no extra latency incurred by the reverse delay upon a switch from forward mode. Reverse delay audio output is available after a mode switch as soon as it would be if it had been continuously on.

In the switch from reverse mode to forward mode, the reverse delay output is rapidly faded out at the end of its half buffer, and the forward delay output begins. Like the forward to reverse mode switch, the rate of this fade is determined by the above constant.

Again, because the input to the overall circular buffer is continuous, always, there is no extra latency incurred by the forward delay upon a switch from reverse mode and as illustrated, data at the end of each half buffer is the same as that for a forward delay. Forward delay audio output is available after a mode switch as soon as it would be if it had been continuously on.

The best mode for carrying out the invention has been described for purposes of illustrating the best mode known to the applicant at the time. The examples are illustrative only and not meant to limit the invention, as measured by the scope and merit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. A device which comprises an audio input into one main buffer, said input written to the main buffer at a sample rate;

a modified audio output;

at least three sub-buffers within the one main buffer, which comprise:

at least one forward sub-buffer within the main buffer which digitally stores audio data for a forward delay effect, the at least one forward sub-buffer having a forward sub-buffer starting location and a forward sub-buffer ending location, a difference between the forward sub-buffer starting location and the forward sub-buffer ending location defining a forward sub-buffer duration;

at least one primary reverse sub-buffer which digitally stores audio data for a reverse delay effect, the at least one primary reverse sub-buffer having a primary reverse sub-buffer starting location and a primary reverse sub-buffer ending location, a time difference between the primary reverse sub-buffer starting location and the primary reverse sub-buffer ending location defining a primary reverse sub-buffer duration, the primary reverse sub-buffer duration being shorter than the forward sub-buffer duration, and the primary reverse sub-buffer duration being coextensive with at least a portion of the forward sub-buffer duration;

at least one secondary reverse sub-buffer which digitally stores audio data for the reverse delay effect, the at least one secondary reverse sub-buffer having a secondary reverse sub-buffer starting location and a secondary reverse sub-buffer ending location defining a secondary reverse sub-buffer duration, the secondary reverse sub-buffer duration being of a shorter duration than the forward sub-buffer duration, and the secondary reverse sub-buffer duration being coextensive with at least a portion of the forward sub-buffer duration and at least a portion of the primary reverse sub-buffer duration.

2. The device of claim 1 wherein the duration of each of the at least one primary and secondary reverse sub-buffers are approximately equal and wherein, the duration of the at least one forward sub-buffer is approximately equal to the duration of the sum of the duration of the at least one primary and secondary reverse sub-buffers.

3. The device of claim 1 wherein the duration of the arithmetic sum of the duration of the at least one primary and secondary reverse sub-buffers is not equal to the duration of the at least one forward sub-buffer.

4. The device of claim 2 wherein the duration of the overlap of the at least one primary reverse sub-buffer and the at least one secondary reverse sub-buffer is approximately 50%.

5. The device of claim 3 wherein the duration of the overlap of the at least one primary reverse sub-buffer and the at least one secondary reverse sub-buffer is not equal to approximately 50%.

6. The device of claim 4 wherein the switch between an output of the primary reverse sub-buffer and the secondary reverse sub-buffer occurs approximately at 50% of a duration of either the primary or secondary reverse delay sub-buffer.

7. The device of claim 6 wherein the primary reverse sub-buffer has a reverse delay sub-buffer #1 mix, and the secondary reverse sub-buffer has a reverse delay sub-buffer #2 mix, and further wherein the reverse delay sub-buffer mix #1=(1.0–reverse sub-buffer mix #2).

8. The device of claim 6 wherein the switch between an output of the primary reverse sub-buffer and the secondary reverse sub-buffer occurs approximately at a reverse delay half buffer.

9. The device of claim 8 wherein throughout a majority of the duration of either reverse sub-buffer, either reverse buffer mix #1 is approximately 1.0 or reverse buffer mix #2 is approximately 1.0, the switch in output from the respective reverse sub-buffers occurring as the sub-buffer approaches the half buffer of either reverse sub-buffer #1 or reverse sub-buffer #2.

10. The device of claim 1 wherein a change from the forward delay effect to the reverse delay effect occurs essentially instantaneously.

11. The device of claim 1 wherein a change from the reverse delay to the forward delay occurs at the end of a reverse half-buffer.

12. The device of claim 1 wherein the main buffer is a circular buffer.

13. The device of claim 1 wherein the modified audio output transitions from a reverse delay to a forward delay or from a forward delay to a reverse delay by the activation of a footswitch.

14. A device which comprises an audio input is written into one main buffer, said input written to the main buffer at a sample rate;

a modified audio output;

a switch to change between a forward delay and a reverse delay;

three sub-buffers within the one main buffer, which comprise:

one forward sub-buffer which digitally stores audio data for a forward delay effect, the forward sub-buffer having a forward sub-buffer starting location and a forward sub-buffer ending location, a difference between the forward sub-buffer starting location and the forward sub-buffer ending location defining a forward sub-buffer duration;

one primary reverse circular sub-buffer which digitally stores audio data for a reverse delay effect, the primary reverse sub-buffer having a primary reverse sub-buffer starting location and a primary reverse sub-buffer ending location, a time difference between the primary reverse sub-buffer starting location and the primary reverse sub-buffer ending location defining a primary reverse sub-buffer duration, the primary reverse sub-buffer duration being shorter than the forward sub-buffer duration, and the primary reverse sub-buffer duration being coextensive with at least a portion of the forward sub-buffer duration;

one secondary reverse sub-buffer which digitally stores audio data for the reverse delay effect, the one secondary reverse circular sub-buffer having a secondary reverse sub-buffer starting location and a secondary reverse sub-buffer ending location defining a secondary reverse sub-buffer duration, the secondary reverse sub-buffer duration being shorter than the forward sub-buffer duration, and the secondary reverse sub-buffer duration being coextensive with at least a portion of the forward sub-buffer duration and at least a portion of the primary reverse sub-buffer duration; and further wherein the duration of each of the primary and secondary reverse sub-buffers are approximately equal and wherein, the duration of the forward sub-buffer is approximately equal to the duration of the sum of the duration of the primary and secondary reverse sub-buffers.

15. The device of claim 14 wherein the switch between an output of the primary reverse sub-buffer and the secondary reverse sub-buffer occurs approximately at 50% of a duration of either the primary or secondary reverse delay sub-buffers.

16. The device of claim 15 wherein the primary reverse sub-buffer has a reverse delay sub-buffer #1 mix, and the secondary reverse sub-buffer has a reverse delay sub-buffer #2 mix, and further wherein the reverse delay sub-buffer mix #1=(1.0–reverse sub-buffer mix #2).

17. The device of claim 16 wherein the switch between an output of the primary reverse sub-buffer and the secondary reverse sub-buffer occurs approximately at a reverse delay half buffer.

18. The device of claim 17 wherein throughout a majority of the duration of either reverse sub-buffer, either reverse buffer mix #1 is approximately 1.0 or reverse buffer mix #2 is approximately 1.0, and the switch in output from the respective reverse sub-buffers occurring as the sub-buffer approaches the half buffer of either reverse sub-buffer #1 or reverse sub-buffer #2.

19. The device of claim 18 wherein a change from the forward delay effect to the reverse delay effect occurs essentially instantaneously.

20. The device of claim 19 wherein a change from the reverse delay to the forward delay occurs at the end of a reverse half-buffer.

21. The device of claim 20 wherein a cross fade between reverse sub-buffer #1 to reverse sub-buffer #2 is between approximately 2 to 25 milliseconds inclusive of the endpoints.

22. The device of claim 21 wherein a default effect for the switch is reverse delay.

23. The device of claim 14 wherein the switch to change between a forward delay and a reverse delay is a foot-activated switch.

24. The device of claim 14 wherein the main buffer is a circular buffer.

25. A device which transitions from a forward delay effect to a reverse delay effect or vice-versa which comprises:

a main buffer which captures audio input;

at least three sub-buffers which store a portion of the audio input, at least one sub-buffer which captures audio input for subsequent output as a forward delay effect and at least two sub-buffers which capture audio input for subsequent output as a reverse delay effect;

a switch for changing the output from the reverse delay to the forward delay or vice-versa; and wherein the changing of the output from the forward delay effect to the reverse delay effect occurs essentially instantaneously, and the change from the reverse delay to the forward delay effect occurs at the end of a reverse half-buffer of the at least two sub-buffers.

26. The device of claim 25 wherein the switch for changing the output from the forward delay effect to the reverse delay effect is a foot-activated switch.

27. The device of claim 26 wherein a cross fade between the at least two sub-buffers which capture audio input for subsequent output as a reverse delay effect is between approximately 2 to 25 milliseconds inclusive of the endpoints.

* * * * *